US010444693B2

(12) United States Patent
Hirano et al.

(10) Patent No.: US 10,444,693 B2
(45) Date of Patent: Oct. 15, 2019

(54) IMAGE FORMING APPARATUS

(71) Applicant: CANON KABUSHIKI KAISHA, Tokyo (JP)

(72) Inventors: Masayuki Hirano, Matsudo (JP); Koichiro Ino, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/174,661

(22) Filed: Oct. 30, 2018

(65) Prior Publication Data

US 2019/0129347 A1 May 2, 2019

(30) Foreign Application Priority Data

Nov. 2, 2017 (JP) ..... 2017-212906
Nov. 8, 2017 (JP) ..... 2017-215269

(51) Int. Cl.
*G03G 15/00* (2006.01)
*G03G 15/01* (2006.01)

(52) U.S. Cl.
CPC ..... *G03G 15/6561* (2013.01); *G03G 15/0131* (2013.01)

(58) Field of Classification Search
CPC ..... G03G 15/6561; G03G 15/0131
See application file for complete search history.

(56) References Cited

U.S. PATENT DOCUMENTS 10,031,459 B2 7/2018 Ino et al.
2008/0170277 A1* 7/2008 Bae ..... H04N 1/506 358/504
2012/0163880 A1* 6/2012 Kuroki ..... G03G 15/5058 399/301
2017/0336737 A1* 11/2017 Takahashi ..... G03G 15/5058

FOREIGN PATENT DOCUMENTS

JP 2001324849 A * 11/2001
JP 2013-025184 A 2/2013

* cited by examiner

*Primary Examiner* — Susan S Lee
(74) *Attorney, Agent, or Firm* — Venable LLP

(57) ABSTRACT

An image forming apparatus includes a plurality of image forming units configured to form images of different colors on a transfer member, a comparator configured to compare values of color patterns measured by a sensor with a threshold, and a controller configured to determine whether the threshold corresponds to a target threshold for a current color pattern among the color patterns while the color patterns are measured by the sensor, detect color misregistration concerning the color patterns based on a comparison result of the comparator, and control relative positions of images of the different colors to be formed by the plurality of image forming units, based on the color misregistration.

17 Claims, 20 Drawing Sheets

IMAGE FORMING APPARATUS

BACKGROUND OF THE INVENTION

Field of the Invention

The present invention relates to an image forming apparatus that forms an image of a plurality of colors.

Description of the Related Art

Conventionally, there have been known image forming apparatuses of an electrophotography method that form images of a plurality of colors. The image forming apparatuses include image forming apparatuses that form images with toner in recording media of a copying machine, a printer, a facsimile machine and the like. There is, for example, an apparatus of a tandem method that forms images through an electrophotography process of charging, exposure, development and transfer respectively for respective colors of yellow (Y), magenta (M), cyan (C) and black (K), and superimpose the respective colors to obtain a color image. In the apparatus of this kind, in order to restrain misregistration, it is necessary to accurately control timings of sheet feeding and image formation. For this purpose, it is common practice to form pattern images for detecting misregistration on an intermediate transfer member, detect the pattern images with an optical sensor, calculate deviation amounts (hereinafter, referred to as misregistration amounts) among the respective colors based on the result, and correct misregistration.

Based on FIGS. 9A, 9B, 9C, 9D, 9E and 9F, relationships among pattern images, outputs of a pattern detecting sensor, and binary signals are described. FIGS. 9A and 9D are each views of a pattern image for detecting misregistration formed on an intermediate transfer member, seen from a horizontal direction, where toner images configuring the pattern images are stacked on the intermediate transfer members. FIGS. 9B and 9E illustrate output signals (sensor outputs) of a misregistration detecting sensor. FIGS. 9C and 9F illustrate binary signals BSa, BSb and BSc that are obtained by binarizing the sensor outputs with thresholds THa, THb and THc. When positional information (pattern position) of a measuring image (referred to as a pattern) of each color is obtained from a waveform of a sensor output, it is common to binarize the sensor output and obtain an intermediate point between a rising (leading) edge and a falling (trailing) edge of the binary signal waveform as a pattern position. The sensor output in the case where an image with a uniform density (toner transferred mass per unit area) as in FIG. 9A has a waveform laterally symmetrical as illustrated in FIG. 9B. When the threshold for binarizing the waveform is made to differ like 75% (threshold THa), 50% (threshold THb) and 25% (threshold THc) with respect to a signal amplitude of the sensor output, the binarized waveforms are respectively, the binary signals BSa, BSb and BSc (FIG. 9C). From these binary signals BSa, BSb and BSc, reg_a, reg_b and reg_c are obtained as the positions of the pattern (FIG. 9C). As illustrated in FIG. 9C, reg_a, reg_b and reg_c have substantially the same value as one another. In this way, when the waveform of the sensor output is an ideal symmetrical waveform, the calculated pattern position does not change even when the threshold is changed.

On the other hand, as in FIG. 9D, when the density (toner transferred mass per unit area) of the pattern image is nonuniform, the sensor output has an asymmetrical waveform as illustrated in FIG. 9E. Then, reg_a, reg_b and reg_c are obtained as the pattern position from the binary signals BSa, BSb and BSc obtained by binarizing the waveforms with the thresholds THa, THb and THc (FIG. 9F). As illustrated in FIG. 9F, reg_a, reg_b and reg_c can be values different from one another. In this way, when the waveform of the sensor output is asymmetrical, the position of the pattern which is calculated varies when the threshold is changed. That is, a difference occurs in the detection result of the pattern position depending on the value of the threshold that is used in binarization to the sensor output waveform.

With respect to the problem like this, Japanese Patent Application Laid-Open No. 2013-25184 proposes the art of restraining a detection error by causing detection widths of patterns to correspond to each other by change or the like of the threshold even when the amplitude of the sensor output varies, and the waveform becomes asymmetrical. That is, Japanese Patent Application Laid-Open No. 2013-25184 conducts control so that a ratio of the threshold level to the amplitude becomes a uniform ratio (50%, for example) even when the signal amplitude of the sensor output corresponding to the adjacent pattern varies greatly. Thereby, a detection error due to waveform asymmetry can be restrained.

When the method that changes the threshold level in accordance with the signal amplitude as in Japanese Patent Application Laid-Open No. 2013-25184 is used, it is necessary to change the threshold level for binarization to the thresholds for the respective colors among patterns of respective colors of yellow, magenta, cyan and black.

However, there is a possibility that the pattern reaches a detection area of the sensor before the threshold level has finished changing to the target level. When the pattern reaches the detection area of the sensor before the threshold level finishes changing to the target level, the edge of the binary signal which is obtained by converting the output signal of the sensor based on the threshold level cannot be detected with high precision. Consequently, there is a possibility that a misregistration amount is erroneously corrected when the pattern reaches the detection area of the sensor before the threshold level has finished changing to the target level.

SUMMARY OF THE INVENTION

Therefore, the present invention provides an image forming apparatus that restrains a misregistration amount from being erroneously corrected.

According to one aspect of the present invention, an image forming apparatus, which forms an image on a sheet, comprises:

a plurality of image forming units configured to form images of different colors;

a transfer member on which color patterns of the different colors formed by the plurality of image forming units are transferred, the color patterns being conveyed by the transfer member;

a sensor configured to measure the color patterns on the transfer member;

a comparator configured to compare measured values of the color patterns by the sensor with a threshold;

a circuit configured to control the threshold; and a controller configured to:

determine whether the threshold corresponds to a target threshold for a current color pattern among the color patterns while the color patterns are measured by the sensor;

detect color misregistration concerning the color patterns based on a comparison result of the comparator; and control relative positions of images of the different colors to be formed by the plurality of image forming units, based on the color misregistration.

Further features of the present invention will become apparent from the following description of exemplary embodiments with reference to the attached drawings.

DESCRIPTION OF THE EMBODIMENTS

The embodiments will be described with reference to the accompanying drawings.

First Embodiment (Image Forming Apparatus)

Figure 1:
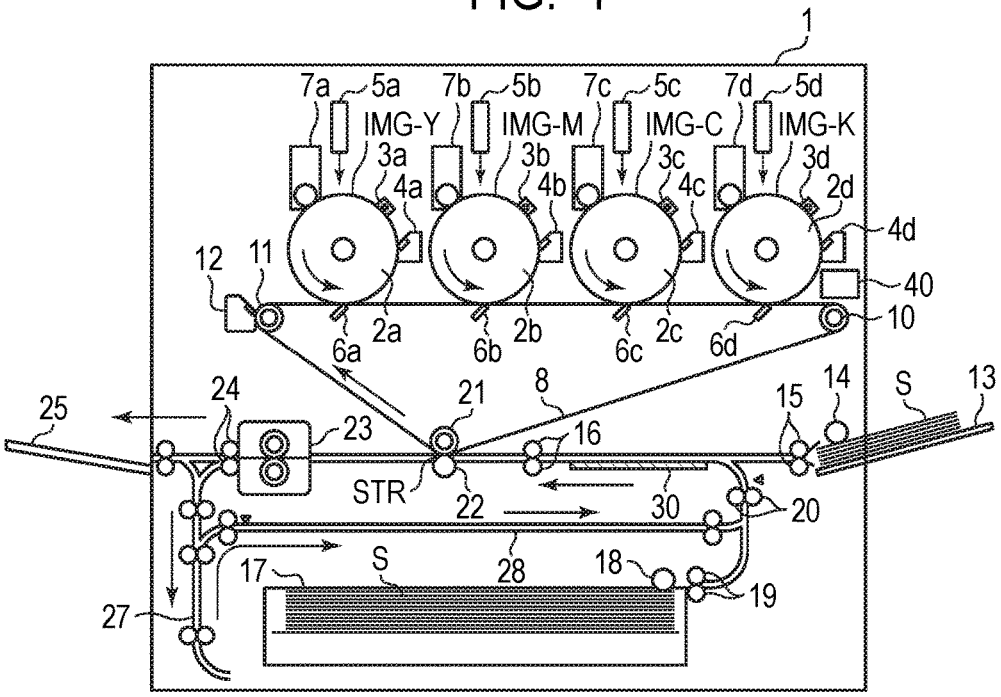
FIG. 1 is a schematic sectional view of an image forming apparatus.

FIG. 1 is a schematic sectional view of an image forming apparatus. An image forming apparatus 1 has four stations IMG (IMG-Y, IMG-M, IMG-C, IMG-K) as an image forming unit for forming an image of a plurality of colors (four colors) of yellow (Y), magenta (M), cyan (C) and black (K). Components of the respective stations IMG are common, so that hereinafter the same reference signs will be used when the respective components are not distinguished for each station IMG, and when the components are distinguished, a, b, c and d are attached after the reference signs. The image forming apparatus 1 has photosensitive drums 2 (2*a*, 2*b*, 2*c*, 2*d*). Chargers 3 (3*a*, 3*b*, 3*c*, 3*d*), laser scanning units 5 (5*a*, 5*b*, 5*c*, 5*d*), primary transfer portions 6 (6*a*, 6*b*, 6*c*, 6*d*), developing devices 7 (7*a*, 7*b*, 7*c*, 7*d*), and cleaners 4 (4*a*, 4*b*, 4*c*, 4*d*) are disposed around the photosensitive drums 2.

Since an image forming operation of each of the colors is common, the image forming operation of yellow will be explained as a representative. The charger 3*a* applies a predetermined voltage to the photosensitive drum 2*a* to charge the photosensitive drum 2*a*. The laser scanning unit 5*a* has a semiconductor laser as a light source, and irradiates a front side of the photosensitive drum 2*a* with laser light in accordance with an image signal to form an electrostatic latent image. Here, a direction in which the light of the laser scanning unit 5*a* scans the photosensitive drum 2*a* is called a main scanning direction, and a direction orthogonal to the main scanning direction is called a sub-scanning direction. The electrostatic latent image on the photosensitive drum 2*a* is developed by the developing device 7*a* to be a toner image. The cleaner 4*a* removes toner remaining on the front side of the photosensitive drum 2*a*. Toner images of the respective colors on the photosensitive drum 2 are sequentially superimposed on an intermediate transfer belt 8 that is an intermediate transfer member with the primary transfer portions 6*a* to 6*d*.

The intermediate transfer belt 8 is wound on rollers 10, 11 and 21, and rotates in a clockwise direction (predetermined direction) in FIG. 1. The toner images of the respective colors which are superimposed on the intermediate transfer belt 8 are conveyed to a secondary transfer portion 22. The secondary transfer portion 22 is disposed to face the roller 21 and forms a secondary transfer nip STR between the secondary transfer portion 22 and the intermediate transfer belt 8. The toner images of the respective colors which are superimposed on the intermediate transfer belt 8 are collectively transferred on a sheet S that is conveyed to the secondary transfer portion 22 in the secondary transfer nip STR. A cleaner 12 removes the toner which remains on the intermediate transfer belt 8. The sheet S on which the toner images of the four colors are collectively transferred in the secondary transfer portion 22 is conveyed to a fixing device 23, where an unfixed toner image is thermally fixed, and thereafter, is discharged to a discharge tray 25 via a discharge roller 24.

The sheet S is fed to a conveyance path from a feeding cassette 17 or a manual feed tray 13, has a lateral position corrected in an electrostatic conveying portion 30 and is conveyed to the secondary transfer portion 22 while timing is being fixed with a registration roller 16. At this time, pickup rollers 18 and 19, a vertical pass roller 20 and the registration roller 16 for feeding the sheet S to the conveyance path from the feeding cassette 17 are respectively driven by independent stepping motors to realize a high-speed stable conveyance operation. Further, pickup rollers 14 and 15 for feeding a sheet to the conveyance path from the manual feed tray 13 are similarly driven respectively by independent stepping motors.

Further, at a time of double-side printing, the sheet S which passes through the fixing device 23 is guided to a double-side reversing path 27 from the discharge roller 24, and thereafter is reversed and conveyed in an opposite direction to be conveyed to a double-side path 28. The sheet S which passes through the double-side path 28 passes through the vertical pass roller 20 again and is conveyed to the secondary transfer portion 22 as described above. The toner images of the respective colors are collectively transferred onto a back side of the sheet S which is conveyed to the secondary transfer portion 22 from the intermediate transfer belt 8, and the sheet S after transfer is discharged to the discharge tray 25 via the fixing device 23 and the discharge roller 24.

The image forming apparatus 1 has a sensor 40 (output unit) for detecting misregistration. The sensor 40 faces an outer peripheral surface that is a surface on which an image is formed in the intermediate transfer belt 8, and is disposed in a position between the photosensitive drum 2*d* and the roller 10. The sensor 40 is for detecting a pattern image PT1 (FIG. 4A) for detecting misregistration which is transferred on the intermediate transfer belt 8 (on an intermediate transfer member) from the respective photosensitive drums 2, and a pattern image PT2 (FIG. 5A) for threshold setting. The sensor 40 has a drive timing controlled by a synchronizing portion (not illustrated). The pattern images PT1 and PT2 include patterns (measuring images) of toner images of the respective colors, and are transferred onto the intermediate transfer belt 8.

(Misregistration Detecting Sensor)

Figure 2:
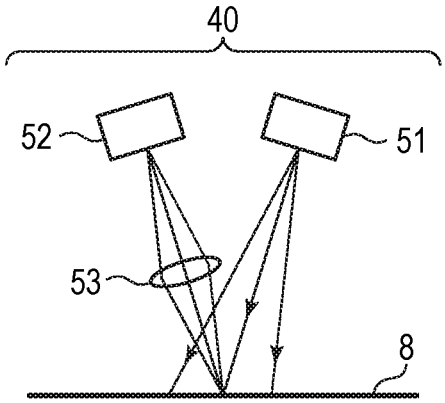
FIG. 2 is a view illustrating a configuration of a sensor.

Hereinafter, the misregistration detecting sensor (hereinafter, referred to as the sensor) 40 as a detecting unit will be described. FIG. 2 is a view illustrating a configuration of the sensor 40. The sensor 40 has a light emitting portion 51 and a light receiving portion 52. The light receiving portion 52 detects specular reflection light of an object that receives light from the light emitting portion 51. Irradiation light from the light emitting portion 51 reflects on a front side of the intermediate transfer belt 8 (the pattern images PT1 and PT2 in the case where the pattern images PT1 and PT2 are formed), and the reflected light is gathered by a lens 53 and is incident on the light receiving portion 52. The light receiving portion 52 outputs an output signal based on a light reception result, specifically, outputs an electric signal (output signal) of an amplitude corresponding to a reception light amount. An output voltage of the light receiving portion 52 is low when a light amount of the reflected light is small, and is high when the light amount is large. That is, the sensor 40 measures the reflected light from the pattern images, and outputs an output value based on the measurement result. Further, in general, a reflectivity is higher on the front side of the intermediate transfer belt 8 as compared with the toner image, so that the output voltage which is the detection result at the time of reading the pattern image is lower than an output voltage at the time of reading the intermediate transfer belt 8. As described in FIGS. 9A to 9F, pattern positions of the respective colors of the pattern images PT1 and PT2 can be derived by binarizing an output waveform of the sensor 40.

(Control Mechanism)

Figure 3:
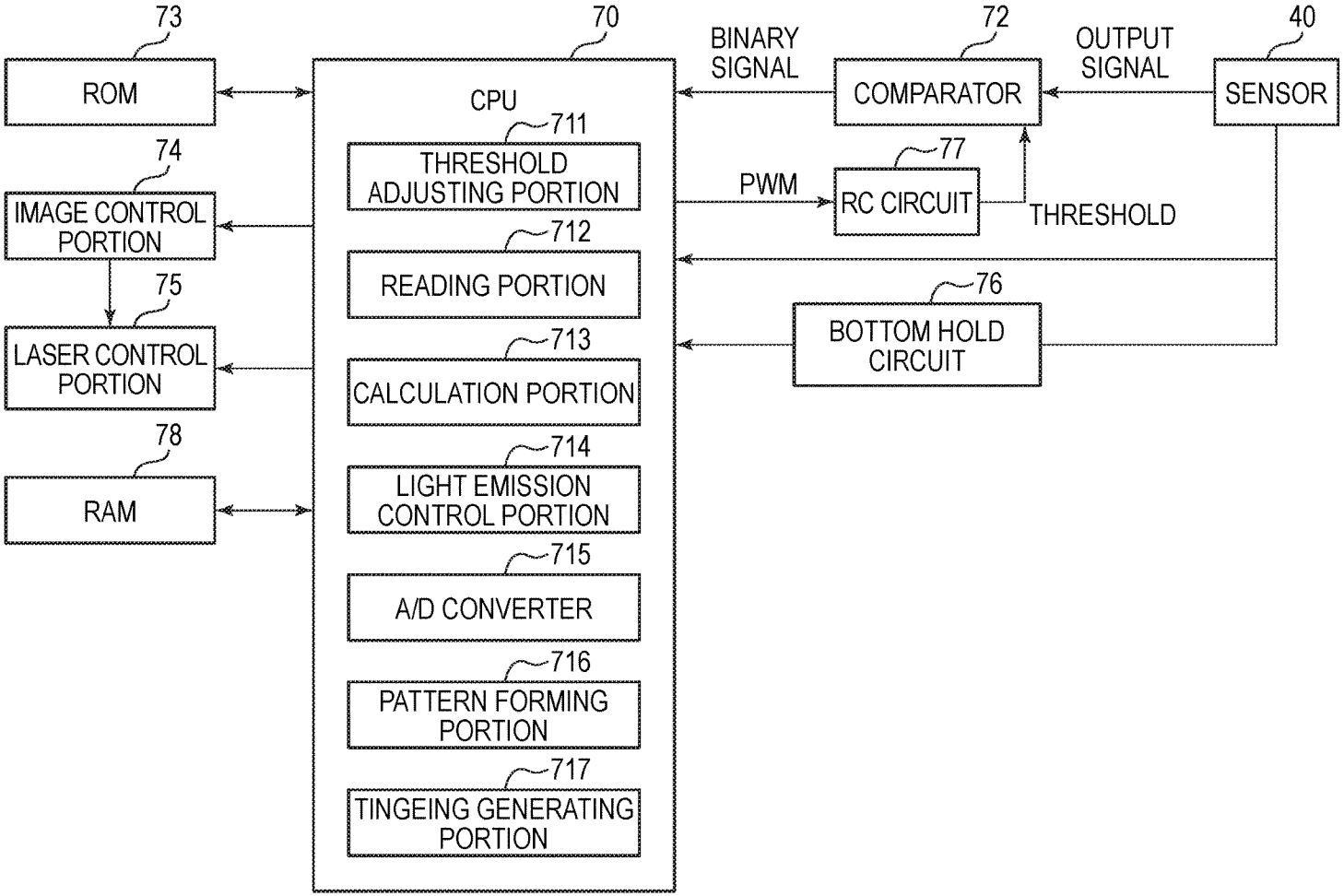
FIG. 3 is a block diagram of a control mechanism of the image forming apparatus.

FIG. 3 is a block diagram of a control mechanism of the image forming apparatus 1. The image forming apparatus 1 has a CPU 70 that conducts control of the entire image forming apparatus 1, and a RAM 78, a ROM 73, a laser control portion 75 and an image control portion 74 are connected to the CPU 70. A control program that is executed by the CPU 70 is stored in the ROM 73, and the RAM 78 is used as a temporary data storage area. An output signal (sensor output value) of the sensor 40 is input to a comparator 72, and is binarized with a threshold th that is set in advance by the CPU 70. The threshold th is set for each color (described later in FIG. 6).

Here, the image forming apparatus 1 needs D/A conversion for controlling a threshold level, but if a D/A converter IC is used for this purpose, cost is increased. Therefore, as an inexpensive method, a pulse width modulation signal (hereinafter, referred to as a PWM signal) is smoothed by using an RC circuit 77. However, in the case of using the RC circuit 77, a problem that is described with references FIGS. 10, 11A, 11B, 12A and 12B occurs.

Figure 10:
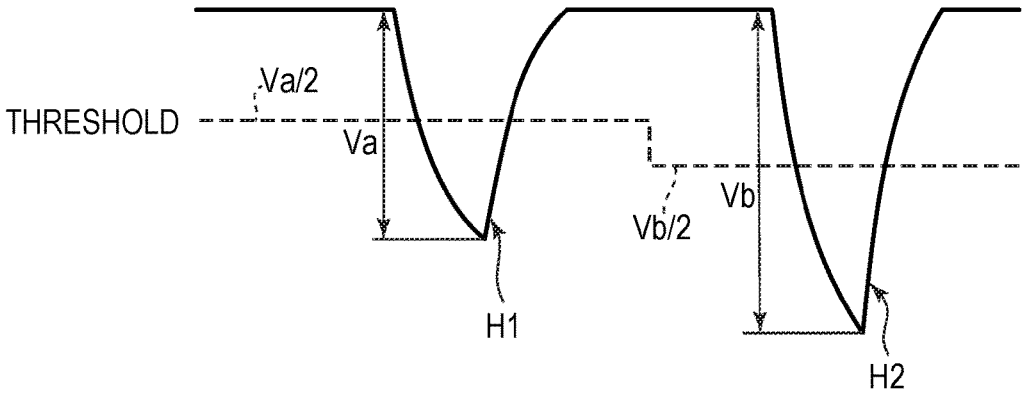
FIG. 10 is a diagram illustrating a relationship between sensor outputs differing in amplitude and thresholds.
Figure 11A:
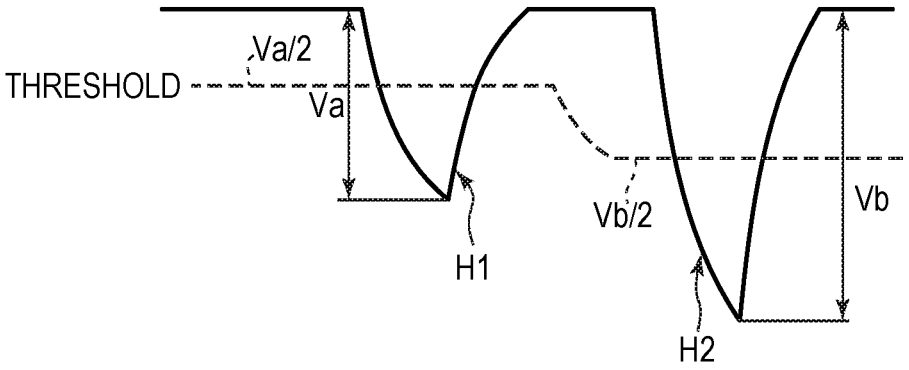
FIGS. 11A and 11B are diagrams illustrating relationships between sensor outputs differing in amplitude and thresholds.
Figure 11B:
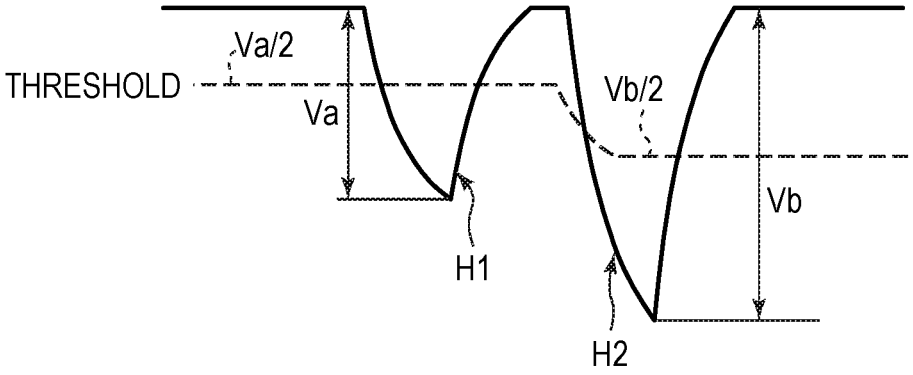

FIGS. 10, 11A and 11B are diagrams each illustrating a relationship between a sensor output and a threshold in the case where sensor outputs with different amplitudes continue. In each of the examples in FIGS. 10, 11A and 11B, a waveform H1 of a signal amplitude Va and a waveform H2 of a signal amplitude Vb continue. Here, it is assumed that a ratio of the threshold level to the amplitude is controlled to be 50%, for example, and a threshold Va/2 is set to the waveform H1, and a threshold Vb/2 is set to the waveform H2. In the example illustrated in FIG. 10, switch to the threshold Vb/2 from the threshold Va/2 is performed without a delay, so that the waveform H2 is binarized with an appropriate threshold level (threshold Vb/2).

In each of the examples in FIGS. 11A and 11B, the threshold level is assumed to be generated as an analog signal obtained by smoothing a PWM signal. Therefore, a time is required until the threshold level stabilizes to a target signal level. In the example in FIG. 11A, after switch to the threshold Vb/2 from the threshold Va/2 is started, the threshold level reaches the threshold Vb/2 and stabilizes, and thereafter a falling edge of the waveform H2 occurs. Accordingly, the waveform H2 is binarized with the appropriate threshold level (threshold Vb/2). However, as illustrated in FIG. 11B, when misregistration between the respective colors increases and adjacent patterns are close to each other, a falling edge of the waveform H2 occurs before the threshold level reaches the threshold Vb/2 and stabilizes. Then, the waveform H2 cannot be binarized with the appropriate threshold level (threshold Vb/2), and an error occurs to the binary signal.

Figure 9A:
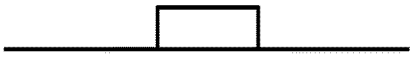
FIGS. 9A and 9D are diagrams illustrating pattern images.
Figure 9D:
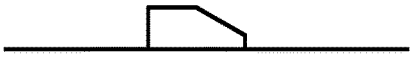
Figure 9B:
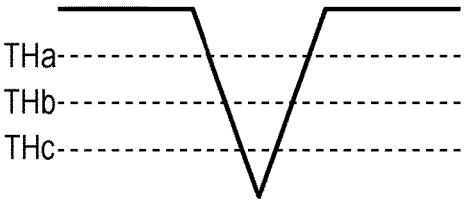
FIGS. 9B and 9E are diagrams illustrating sensor outputs.
Figure 9E:
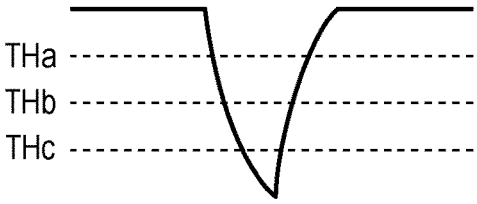
Figure 9C:
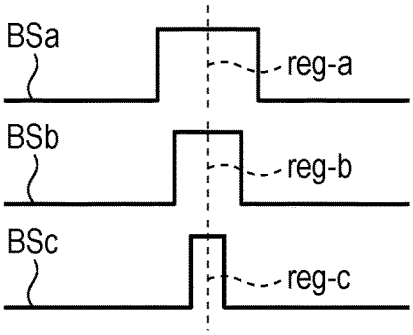
FIGS. 9C and 9F are diagrams illustrating binary signals.
Figure 9F:
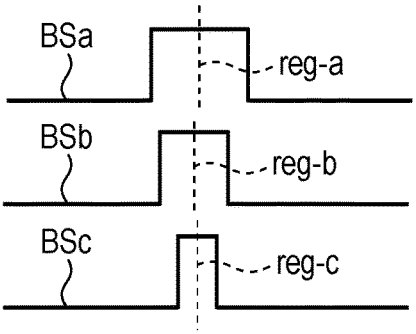
Figure 12A:
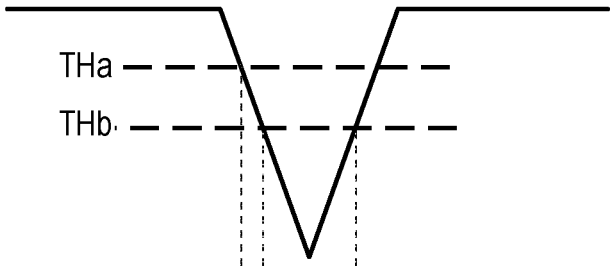
FIGS. 12A and 12B are diagrams illustrating the sensor output and the binary signals.
Figure 12B:
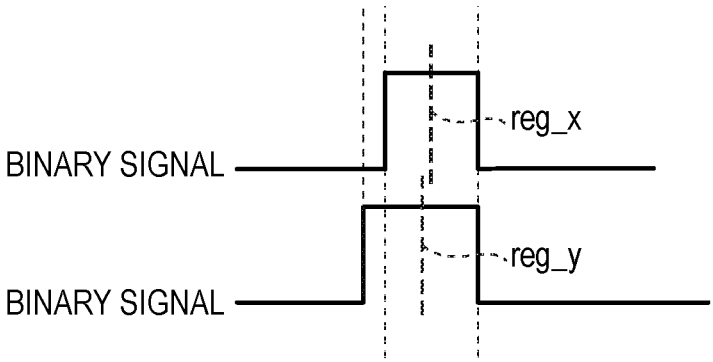

Further, even if the waveform is symmetrical, a detection error may occur. FIGS. 12A and 12B are diagrams each illustrating a sensor output and a binary signal. When different threshold levels are applied at a falling edge and a rising edge of the waveform H of the sensor output, a detection error can occur even in the case of the laterally symmetrical waveform as illustrated in FIG. 9B. For example, in an example of an upper tier in FIG. 12B, a waveform H occurs after the threshold level after switching stabilizes to a threshold b, so that at the falling edge and the rising edge of the waveform H of the sensor output, the common threshold b is used in binarization, and reg_x is obtained as a position of the pattern. In this case, a detection error does not occur. However, in an example of a lower tier in FIG. 12B, a transition to the threshold b is stabilized in a time period between the falling edge and the rising edge of the waveform H, so that a threshold a is used in binarization at the falling edge of the waveform H of the sensor output, and the threshold b is used in binarization at the rising edge of the waveform H, respectively. Then, the position of the pattern is reg_y with respect to reg_x that is an original pattern position, and a detection error occurs. That is, when the sensor output signal reaches before the threshold level stabilizes to a value after switching, a detection error occurs even when the waveform is symmetrical.

Explanation will be returned to FIG. 3. The signal indicating the threshold is generated by the PWM signal which is output from the CPU 70 being smoothed by the RC circuit 77. A signal that is binarized in the comparator 72 (hereinafter, referred to as a binary signal) is input to the CPU 70. The comparator 72 is a comparing unit that compares a sensor output value of the calculation portion sensor 40 with the threshold th, and obtains a binary signal as a result of the comparison.

The CPU 70 includes a threshold adjusting portion 711, a reading portion 712, a calculation portion 713, a light emission control portion 714, an A/D converter 715, a pattern forming portion 716 and a timing generating portion 717. The threshold adjusting portion 711 adjusts a DUTY ratio of the PWM signal that generates a threshold that is used in the comparator 72. The reading portion 712 detects a rising edge and a falling edge of a binary signal, and calculates timings of the edges. The calculation portion 713 calculates a misregistration amount from the rising/falling timing calculated by the reading portion 712. A bottom hold circuit 76 is used when the CPU 70 samples the value of the sensor output by a threshold setting process (FIG. 6) that will be described later.

The timing generating portion 717 is used in switching control of the threshold in a misregistration obtaining process (FIG. 7) that will be described later. The light emission control portion 714 controls light emission of the light emitting portion 51 of the sensor 40. The A/D converter 715 converts the output level of the sensor 40 and records the output level. The pattern forming portion 716 forms the pattern images PT (PT1, PT2). The pattern forming portion 716 stores pattern image data for forming each of the pattern image PT1 for detecting misregistration and the pattern image PT2 for threshold setting. The pattern forming portion 716 sends the pattern image data to the laser control portion 75. In the RAM 78, the threshold that is set to the comparator 72, the misregistration amount calculated in the calculation portion 713 and the like are stored, and at an actuation time or the like, the CPU 70 refers to the threshold, misregistration amount and the like, and performs setting to the image control portion 74 and the like. In the ROM 73, predetermined values set in advance, programs and the like are stored.

(Misregistration Calculation Method)

Figure 4A:
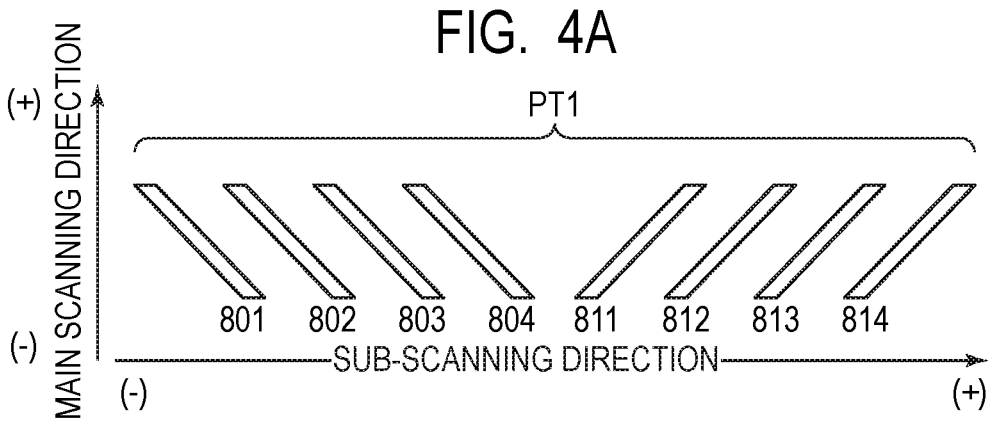
FIG. 4A is a view illustrating a pattern image PT1 for detecting misregistration.
Figure 4B:
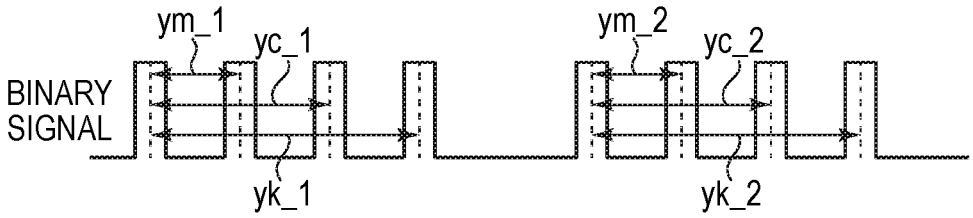
FIG. 4B is a diagram illustrating an example of a signal after binarization.

Next, a misregistration calculation method by the calculation portion 713 will be described. FIGS. 4A and 4B illustrate an example of the pattern image PT1 for detecting misregistration and a detection signal (after binarization) of the sensor 40 that reads the pattern image PT1. The pattern image PT1 is configured by yellow patterns 801 and 811, magenta patterns 802 and 812, cyan patterns 803 and 813 and black patterns 804 and 814. A moving direction of the pattern image PT1 corresponds to the sub-scanning direction. When the pattern image PT1 is formed on the intermediate transfer belt 8, a moving direction of the intermediate transfer belt 8 corresponds to the sub-scanning direction. The patterns of the respective colors are formed to be inclined at 45° to the main scanning direction, and inclination directions in the patterns 801 to 804 and the patterns 811 to 814 are opposite from each other.

Broken lines illustrated in FIG. 4B each show a center position between a rising edge and a falling edge of a binary signal. Time information ym_1, yc_1 and yk_1 are values obtained by converting distances from the center position of the pattern 801 of yellow that is a reference color to center positions of the patterns 802, 803 and 804 of the other colors into times. Likewise, time information ym_2, yc_2, and yk_2 are values obtained by converting distances from the center position of the yellow pattern 811 to center positions of the patterns 812, 813 and 814 of the other colors into times. Misregistration amounts are calculated from these kinds of time information.

For example, calculation of a misregistration amount of magenta will be described. When the patterns 802 and 812 of magenta misregister in a (+) direction in the sub-scanning direction, a ym_1 value and a ym_2 value increase by same amounts proportionally to misregistration amounts. When the patterns 802 and 812 misregister to a (−) side in the sub-scanning direction, the ym_1 value and the ym_2 value also change (decrease) by the same amounts. On the other hand, when the patterns 802 and 812 misregister in a (+) direction of the main scanning direction, the ym_1 value increases proportionally to a misregistration amount, whereas the ym_2 value decreases by the same amount. When the patterns 802 and 812 misregister to a (−) side in the main scanning direction, the ym_1 value decreases, and the ym_2 value increases by a same amount as this. Consequently, the misregistration amounts (the sub-scanning misregistration, the main scanning misregistration) are calculated from expressions 1 and 2 described below.

$$\text{Sub-scanning misregistration} = X - (ym_1 + ym_2)/2 \times \text{conveying speed} \quad (1)$$

$$\text{Main-scanning misregistration} = (ym_1 - ym_2)/2 \times \text{conveying speed} \quad (2)$$

In expression 1, X represents distance interval information (value obtained by converting distance into time) in the sub-scanning direction of the yellow pattern and the magenta pattern in the case where misregistration does not occur. The ym_1 value and the ym_2 value are time information (sec), so that when a misregistration amount is calculated, the ym_1 value and the ym_2 value are converted into distance information by using the conveying speed (mm/sec) of the intermediate transfer belt 8 on which the pattern image PT2 is formed. While expressions 1 and 2 are expressions of an example of the misregistration of magenta, the misregistration amounts of the other colors also can be similarly derived by using the time information with the yellow patterns 801 and 811 as the reference. Note that the reference color may be the colors other than yellow.

Figure 5A:
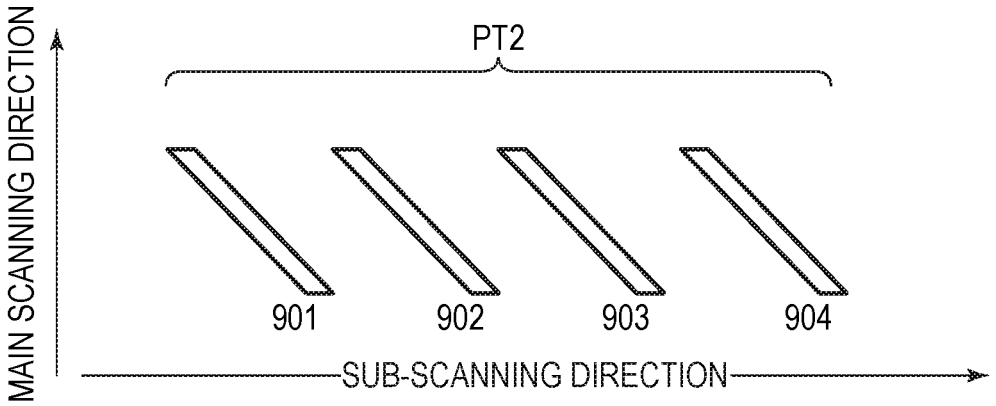
FIG. 5A is a view illustrating a pattern image PT2 for setting a threshold.
Figure 5B:
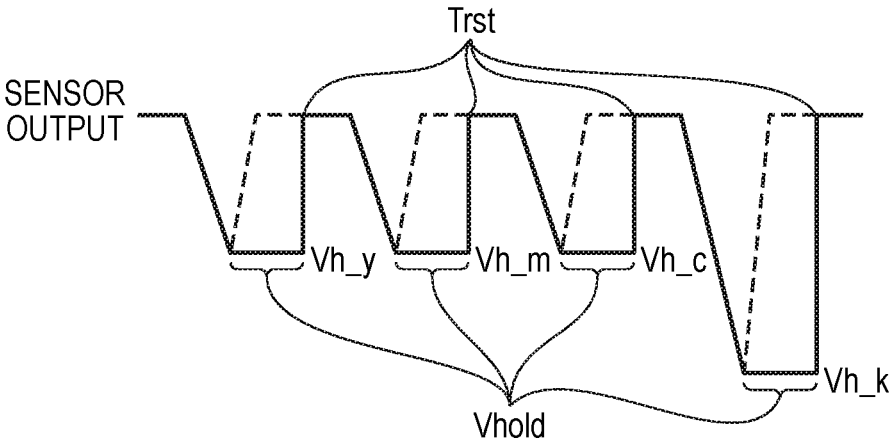
FIG. 5B is a diagram illustrating an output example of the sensor.

FIG. 5A is a diagram illustrating an example of the pattern image PT2 for threshold setting. FIG. 5B is a diagram illustrating an output example of the sensor 40 that reads the pattern image PT2. The pattern image PT2 is configured by a yellow pattern 901, a magenta pattern 902, a cyan pattern 903 and a black pattern 904 similarly to the pattern image PT1. The patterns of the respective colors are formed to be inclined at 45° with respect to the main scanning direction. Intervals (sub-scanning direction lengths) among the patterns of the respective colors in the pattern image PT2 are longer than the intervals among the patterns of the respective colors in the pattern image PT1. This is because it is necessary to sample-hold a sample value of the sensor output (FIG. 5B) by the bottom hold circuit 76.

(Threshold Setting Process)

Figure 6:
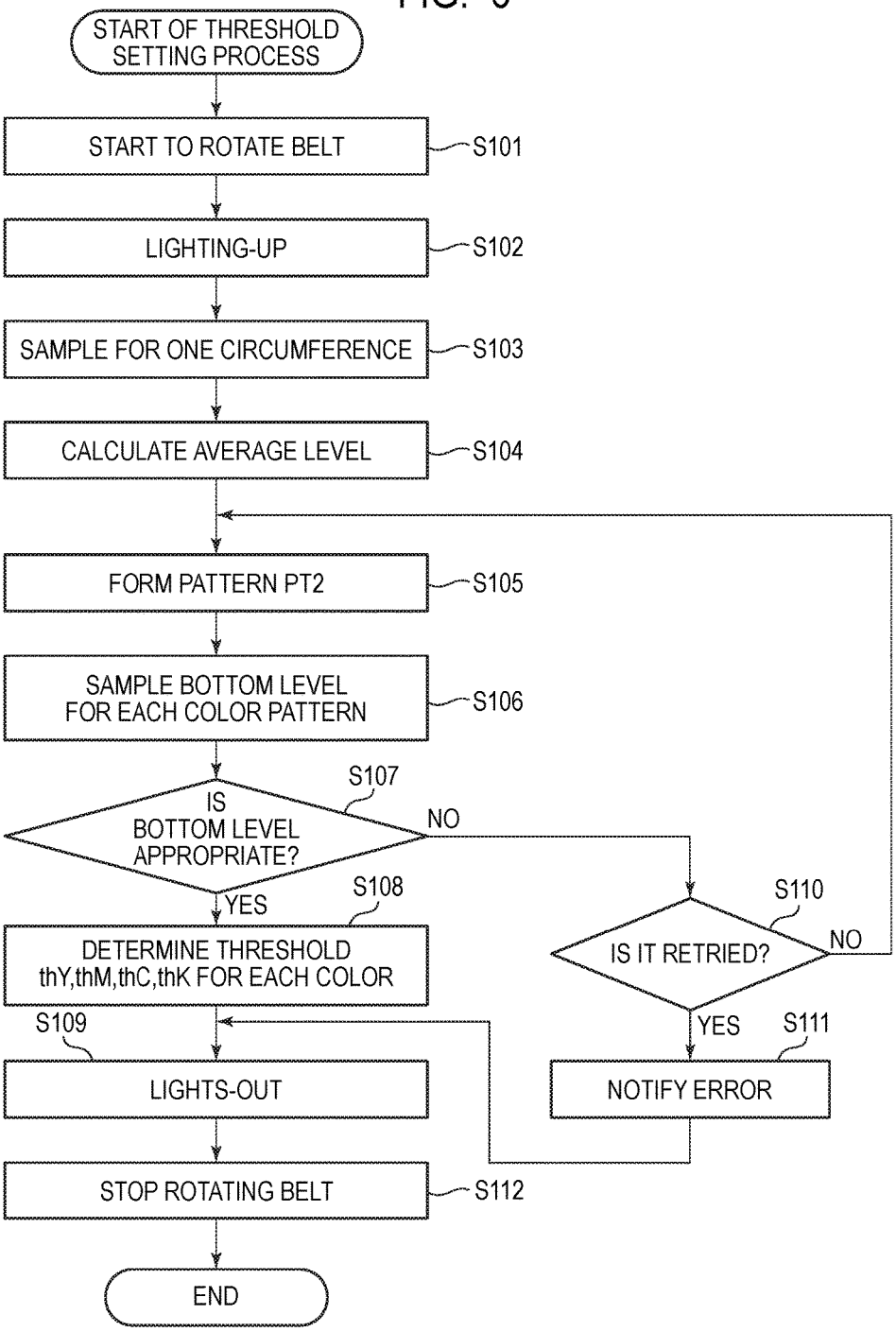
FIG. 6 is a flowchart of a threshold setting process.

Next, a process of determining a threshold th for each color by using the pattern image PT2 will be described by using FIG. 6. FIG. 6 is a flowchart of a threshold setting process. The process of the flowchart is realized by the CPU 70 reading and executing a program stored in the ROM 73.

First, the CPU 70 starts to rotate the intermediate transfer belt 8 (step S101), and causes the light emitting portion 51 of the sensor 40 to emit light (light up) (step S102). Subsequently, the CPU 70 samples the output signal of the sensor 40 that receives reflected light from the intermediate transfer belt 8 (on the intermediate transfer member) in a state in which a toner image is not formed, for one circumference of the intermediate transfer belt 8 (step S103). A sampling interval at this time is an interval of 100 msec, for example. Next, the CPU 70 calculates an average level Base_ave of sampling data for one circumference which is obtained, and stores the value in the RAM 78 (step S104). Next, the CPU 70 controls the stations IMG, and forms the pattern image PT2 on the intermediate transfer belt 8 (step S105).

Subsequently, the CPU 70 samples a bottom level of the sensor output by the sensor 40, of each color pattern in the pattern image PT2 with respect to each of yellow, magenta, cyan and black (step S106). In the sampling, the CPU 70 samples an output signal which is bottom-held by the bottom hold circuit 76 three times at intervals of 5 msec in the time period Vhold illustrated in FIG. 5B for each color. Subsequently, the CPU 70 causes the RAM 78 to store an average value of the values of three times as the bottom level of the sensor output of each color. As illustrated in FIG. 5B, as for the bottom level of each color, a bottom level of yellow is Vh_y, a bottom level of magenta is Vh_m, a bottom level of cyan is Vh_c and a bottom level of black is Vh_k. Hold of the output signal which is held is reset when a timing Trst arrives. Note that the number of sampling times of the output signal which is bottom-held is not limited to three times, but can be one time or more.

Next, the CPU 70 compares the sampled bottom level with the average level Base_ave which is obtained in advance, and determines whether or not the sampled bottom level is an appropriate level in step S107. Specifically, the CPU 70 determines whether or not a difference amount between the bottom level and the average level Base_ave exceeds a predetermined value. The predetermined value is set in advance and is stored in the ROM 73. When the above described difference amount is the predetermined value or less, it can be determined that there is a possibility that the bottom level cannot be accurately detected for the reason that the toner pattern is not formed, a flaw is on the position of the intermediate transfer belt 8 which is read, or the like. In this case, the CPU 70 determines that the bottom level is not an appropriate level (NO in S107), and determines whether or not it is retried (step S110). When it is not retried (NO in S110), the CPU 70 returns the process to step S105. On the other hand, when it is retried (YES in S110), the CPU does not retry but makes error notification (step S111), and advances the process to step S109.

When determining that the sampled bottom level is an appropriate level in step S107 (YES in S107), the CPU 70 determines the threshold th for each color based on the bottom level of each color pattern that is obtained and the average level Base_ave (step S108). Here, the threshold adjusting portion 711 of the CPU 70 determines the threshold th for each color, and calculates thresholds thY, thM, thC and thK respectively for yellow, magenta, cyan and black. While a calculation expression of the threshold thY for yellow is shown in expression 3 as a representative, the thresholds for the other colors are also calculated similarly.

$$\text{Threshold } thY=(\text{Base_ave}-Vh_y)\times\alpha+Vh_y \quad (3)$$

A value of $\alpha$ in this case is 0.5, for example, but is not limited to 0.5. When $\alpha$=0.5, a value of an intermediate (50%) position between the bottom level Vh_y and the average level Base_ave is calculated as the threshold thY by expression 3. Thereafter, the CPU 70 switches off the lights of the light emitting portion 51 of the sensor 40 in step S109, stops rotation of the intermediate transfer belt 8 (step S112), and ends the process in FIG. 6.

(Misregistration Amount Obtaining Process)

The CPU 70 calculates a misregistration amount by using expressions 1 and 2 from the binary signal generated in this way. Thereafter, the image control portion 74 corrects misregistration by changing an image forming condition based on the calculated misregistration amount. For example, in order to correct a relative positional deviation of the image of each color, the image control portion 74 adjusts exposure timing of each color based on the misregistration amount. Alternatively, the image control portion 74 executes an image process to image data to correct a relative positional deviation of the image of each color. The image control portion 74 may be an image processor that executes the image process to the image data. The image control portion 74 corresponds to an adjusting unit. The misregistration amounts correspond to relative positional deviations of the image of the reference color and the images of the other colors. Consequently, by the image control portion 74 adjusting the image forming condition based on the misregistration amount, the positions of the images of the other colors are corrected to the position of the image of the reference color. Thereby, the image forming positions of the images of the respective colors are adjusted. Note that since a method for correcting misregistration is a well-known technique, detailed explanation of the method will be omitted. A detailed process of obtaining a misregistration amount is described with reference to FIG. 7.

Figure 7:
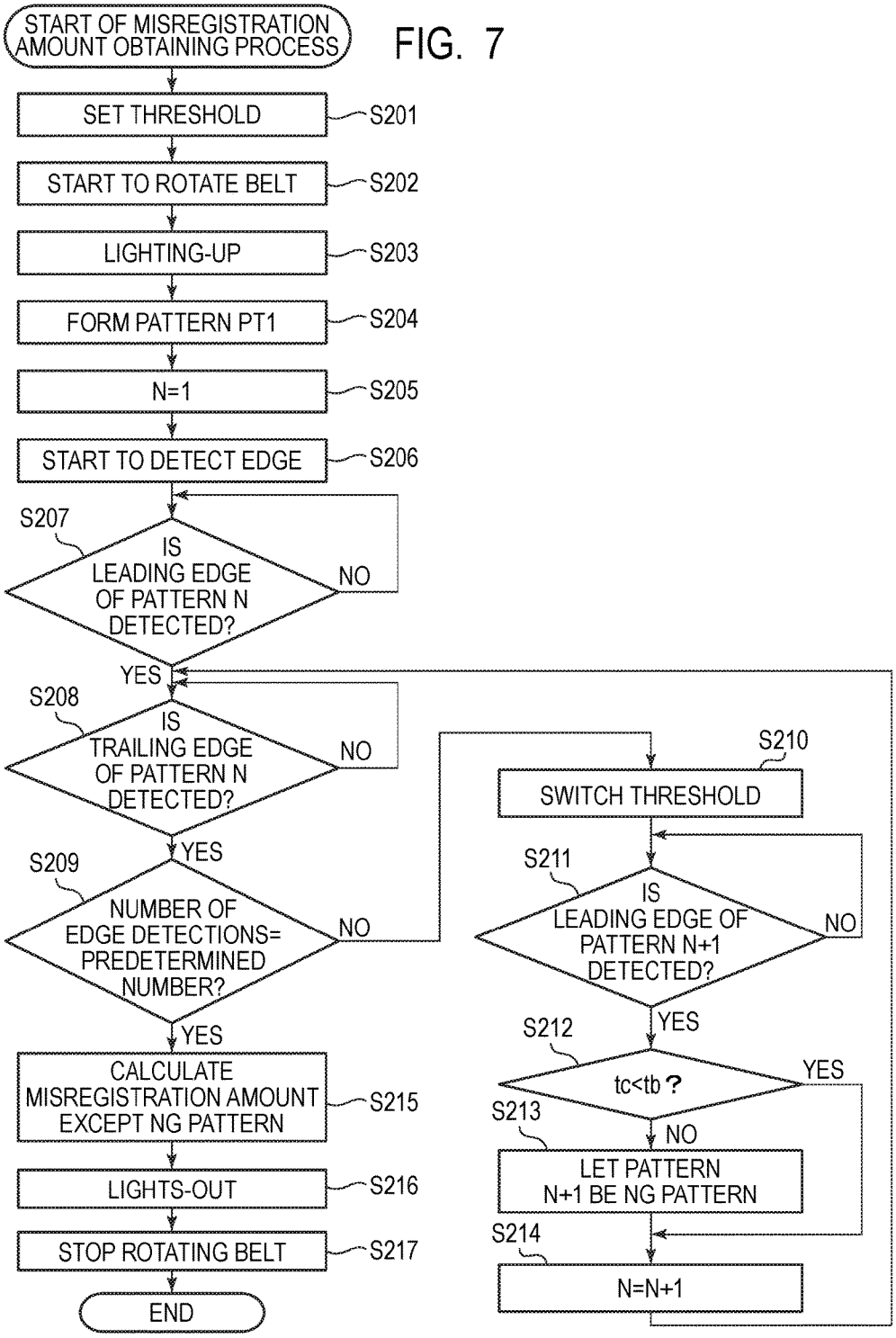
FIG. 7 is a flowchart of a misregistration amount obtaining process of a first embodiment.

FIG. 7 is a flowchart of a misregistration amount obtaining process of a first embodiment. The process of the flowchart is realized by the CPU 70 reading and executing a program stored in the ROM 73. The process is started when a main power source of the image forming apparatus 1 is turned on, or when the image forming apparatus 1 forms a specified number of images or more after the misregistration amount obtaining process is executed at a previous time. Note that the condition of starting the threshold setting process illustrated in FIG. 6 is similar to this. For example, when the main power source is turned on, the CPU 70 executes the threshold setting process illustrated in FIG. 6 in advance, and thereafter shifts to the misregistration amount obtaining process illustrated in FIG. 7. In the process in FIG. 7, the CPU 70 corresponds to a determining unit.

First, the CPU 70 sets the threshold thY for the yellow pattern to be a first detection target in the pattern image PT1 as the threshold for use in binarization, out of the respective thresholds th obtained in the threshold setting process (FIG. 6) (step S201). Thereafter, the CPU 70 starts to rotate the intermediate transfer belt 8 (step S202), and causes the light emitting portion 51 of the sensor 40 to emit light (light up) (step S203). Next, the CPU 70 controls the stations IMG, forms the pattern image PT1 on the intermediate transfer belt 8 (step S204), and sets a counter N for grasping the pattern orders of the respective colors to one that is an initial value (step S205).

Next, the CPU 70 starts to detect edges of a binary signal, that is, a rising edge (leading edge) and a falling edge (trailing edge) of the signal obtained by binarizing the output of the sensor 40 by the comparator 72 (step S206). Here, the pattern in which the sensor output is a target of binarization is described as a pattern N. The first pattern N is a yellow pattern. The CPU 70 waits until the CPU 70 detects the leading edge of the pattern N (step S207), and after detecting the leading edge, the CPU waits until the CPU 70 detects the trailing edge of the pattern N (step S208). After detecting the trailing edge of the pattern N, the CPU 70 determines whether or not the number of edge detection times which is a total number of detection times of the leading edge and the trailing edge from the edge detection start reaches a predetermined number (step S209). Here, the predetermined number is a total number of edges which are detected when the patterns of the respective colors of all the pattern images PT1 can be correctly detected. For example, in the one pattern image PT1, 16 edges are generated, so that when ten sets of the pattern images PT1 are formed, the predetermined number is 160.

When the number of edge detection times does not reach the predetermined number as a result of determination in step S209, the CPU 70 shifts the process to step S210. Here, with reference to FIGS. 8A and 8B, timing for switching the threshold and transition of change of the threshold will be described, in relation to the process of steps S207 to S215.

Figure 8A:
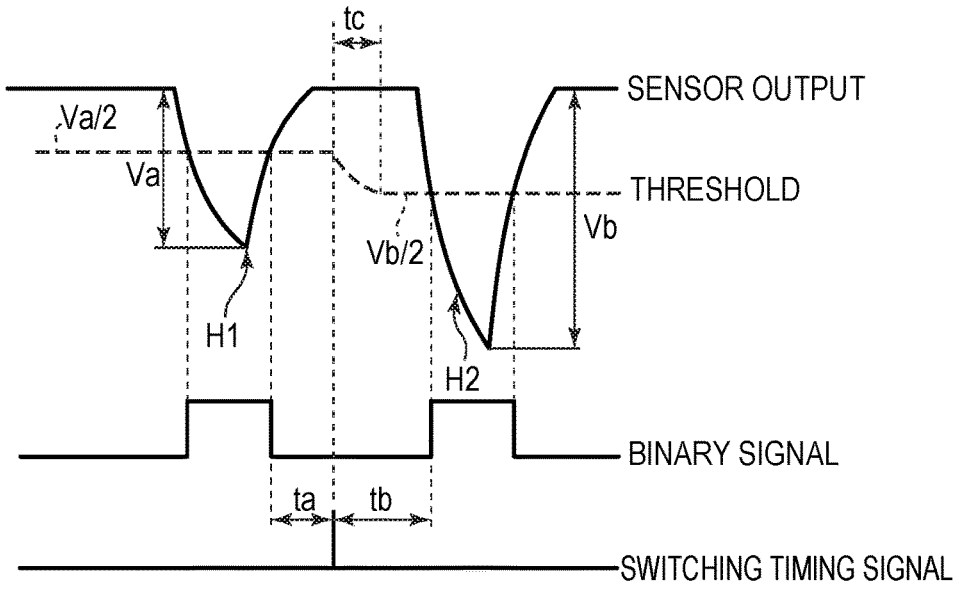
FIGS. 8A and 8B are diagrams each illustrating a relationship among a sensor output, a threshold, a binary signal and a switching timing signal.
Figure 8B:
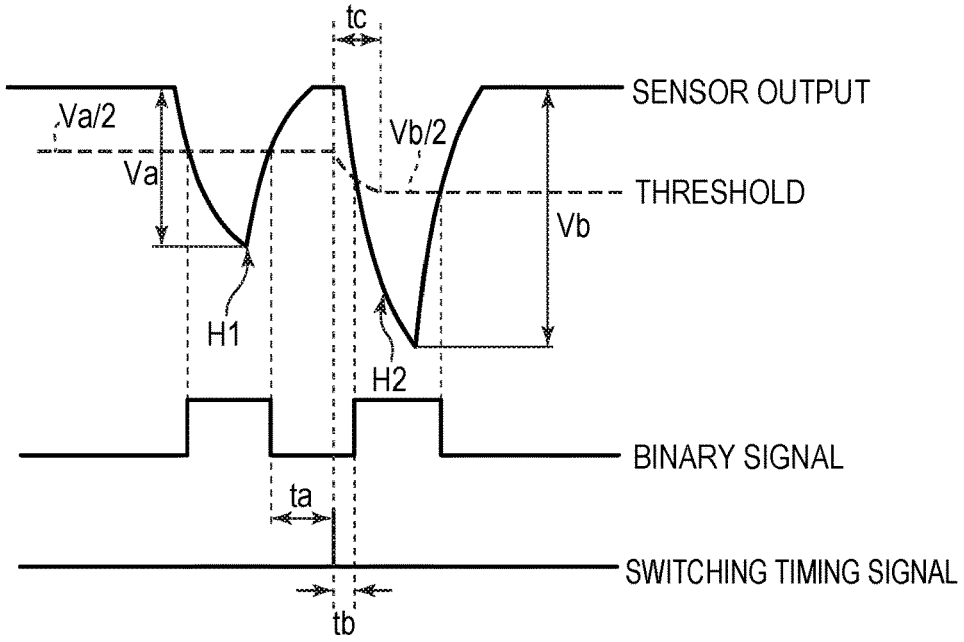

FIGS. 8A and 8B are diagrams each illustrating a relationship of the sensor output, the threshold, the binary signal and a switching timing signal. It is assumed that as the threshold for binarization, a threshold Va/2 is set to a waveform H1, and a threshold Vb/2 is set to a waveform H2. Here, the binary signal changes to a first value at a rising (leading) edge, and changes to a second value at a falling (trailing) edge. The binary signal in the case where the intermediate transfer belt 8 on which no pattern image is transferred is measured is the second value. When the pattern is detected, the CPU 70 generates a switching timing signal (starts switching the threshold) so that the threshold is switched among the patterns. Here, the switching timing signal is generated after a predetermined time "ta" with the falling edge of the binary signal of the immediately preceding pattern as a starting point. By the switching timing signal, a target threshold that is set is changed from the first threshold (Va/2, for example) to the second threshold (Vb/2, for example). Note that as examples of the first threshold and the second threshold, Va/2 and Vb/2 that are values of 50% of the signal amplitude of the sensor output are shown, but the first threshold and the second threshold are not limited to these values. The threshold which is set is generated as an analog signal obtained by smoothing PWM, so that a time is required until the threshold level reaches a target value and is stabilized (switching is ended). The time required for the threshold level to transition to the target value from start of switching of the threshold to be set (from Va/2 to Vb/2) is set as a first required time "tc". In other words, the first required time "tc" is a time until the threshold reaches the second threshold after switching is started from the first threshold for comparing with the output value of the first color pattern in the pattern image PT1 to the second threshold for comparing with the output value of the subsequent second color pattern. The first required time "tc" is determined based on a time constant of the RC circuit 77, and a difference between the first threshold and the second threshold. Note that to be exact, "reaches the second threshold" does not have to necessarily mean that the actual threshold level corresponds to the second threshold which is a target, but may mean that the actual threshold level reaches a value sufficiently close to the second threshold and a predetermined ratio of the difference between the first threshold and the second threshold. The CPU 70 calculates the first required time "tc" when generating the switching timing signal or after generating the switching timing signal.

Subsequently, the CPU 70 calculates a second required time "tb" that is a time until a rising (leading) edge of a binary signal corresponding to the next pattern from generation of the switching timing signal (start switching of the threshold which is set). In other words, the second required time "tb" is a time until a comparison result corresponding to the pattern image of the second color changes after switching from the first threshold to the second threshold is started. In the example in FIG. 8A, the first required time "tc"<second required time "tb" is established. That is, similarly to the example in FIG. 11A, after switching from the threshold Va/2 to the threshold Vb/2 is started, a falling edge of the waveform H2 occurs after the threshold level reaches the threshold Vb/2 and is stabilized. Accordingly, the waveform H2 is binarized with the appropriate threshold level (threshold Vb/2), and with respect to the pattern, a center position of the pattern can be accurately detected.

However, as illustrated in FIG. 8B, there may be a case in which misregistration among the colors increases, and the adjacent patterns are close to each other. In this case, after start of switching the threshold, at a stage where the threshold changes transitionally, that is, before the threshold reaches the threshold Vb/2 and is stabilized, a falling edge of the waveform H2 occurs. Then, similarly to the example in FIG. 11B, the waveform H2 cannot be binarized by an appropriate threshold level (threshold Vb/2), and in particular, a leading edge of the binary signal cannot be correctly obtained. That is, when the first required time "tc"≥second required time "tb" is established as in the example in FIG. 8B, a center position of the pattern cannot be accurately detected.

Then, the CPU 70 conducts control so as to use the binary signal as the comparison result corresponding to the pattern the center position of which can be accurately detected in determination of a misregistration amount, but not to use the binary signal as the comparison result corresponding to the pattern the center position of which cannot be accurately detected in determination of the misregistration amount. Out of the binary signals corresponding to each of the patterns, the binary signal that is excluded from determination of the misregistration amount can exist, so that a plurality of binary signals corresponding to each of the patterns are required. A plurality of sets of pattern images PT1 are formed, and thereby a plurality of binary signals are obtained for each color.

In step S210 in FIG. 7, the CPU 70 (timing generating portion 717) generates a switching timing signal, and the CPU 70 switches a present threshold to a threshold for the next pattern to detect the next pattern (pattern N+1) based on the switching timing signal. For example, at a time of start of a misregistration obtaining sequence, the threshold thY for yellow of the leading pattern is set, and when one leading edge and one trailing edge are detected, a time point at which the predetermined time "ta" elapses from detection of the trailing edge is a switching timing to the threshold thM. The CPU 70 starts switching of the target threshold from the threshold thY to the threshold thM for the magenta pattern which is the next target, at the switching timing.

Next, the CPU 70 waits until the CPU 70 detects the leading edge of the pattern (N+1) (step S211), and when the CPU 70 detects the leading edge, the CPU 70 advances the process to step S212. In step S212, the CPU 70 calculates the first required time "tc", and calculates the second required time "tb" from the start of switching of the threshold to the rising edge of the binary signal corresponding to the pattern (N+1). Note that the CPU 70 may calculate the first required time "tc" in a time period before step S212, after step S210. Subsequently, the CPU 70 determines whether or not the first required time "tc" is less than the second required time "tb" (less than the second required time).

When the first required time "tc" is not less than the second required time "tb" (tc tb), the leading edge of the binary signal corresponding to the pattern (N+1) cannot be obtained correctly. Therefore, the CPU 70 stores information indicating that the pattern (N+1) is an NG pattern in the RAM 78 (step S213), and thereafter, advances the process to step S214. Thereby, the binary signal which is the comparison result corresponding to the pattern (N+1) is excluded from the comparison result that is used in determination of the misregistration amount (step S215). On the other hand, when the first required time "tc" is less than the second required time "tb" (tc<tb), the leading edge of the binary signal corresponding to the pattern (N+1) can be obtained correctly. Thus, the CPU 70 advances the process to step S214 without storing the information indicating that the pattern (N+1) is the NG pattern. Thereby, the binary signal which is the comparison result corresponding to the pattern (N+1) is included in the comparison result that is used in determination of the misregistration amount (step S215).

In step S214, the CPU 70 increments the counter N, returns the process to step S208, and continues detection of the edge. When the number of edge detections reaches the predetermined number as the result of determination in step S209, all the patterns of all the pattern images PT1 are detected, so that the CPU 70 calculates the misregistration amount by using expressions (1) and (2) (step S215). At this time, the CPU 70 refers to the information indicating the NG pattern which is stored in the RAM 78, excludes the comparison result corresponding to the NG pattern out of a plurality of comparison results (binary signals), and determines the comparison result that is used in determination of the misregistration amount. Subsequently, the CPU 70 applies the comparison result that is decided to be used to expressions (1) and (2) and determines the misregistration amount. Note that since a plurality of pattern images PT1 are formed, the CPU 70 obtains (decides) a value obtained by averaging the misregistration amounts derived from the respective pattern images PT1 as the final misregistration amount. Thereby, determination precision of the misregistration amount is enhanced. Thereafter, the CPU 70 lights out the light emitting portion 51 of the sensor 40 (step S216), stops rotating the intermediate transfer belt 8 (step S217) and ends the process in FIG. 7.

According to the present embodiment, the CPU 70 determines the comparison result (binary signal) that is used in determination of the misregistration amount based on the first required time "tc" and the second required time "tb", and determines the misregistration amount based on the determined comparison result. That is, when tc<tb is established, the CPU 70 includes the comparison result corresponding to the pattern of the second color in the comparison result that is used in determination of the misregistration amount, but when tc≥tb is established, the CPU 70 excludes the comparison result corresponding to the pattern of the second color from the comparison result that is used in determination of the misregistration amount. Thereby, determination precision of the misregistration amount can be enhanced. Thereby, the misregistration amount is restrained from being erroneously corrected. In particular, when the configuration in which the PWM signal which controls the threshold is smoothed by the RC circuit or the like is adopted, high determination precision of the misregistration amount can be kept. Further, regardless of whether the waveform of the sensor output is symmetrical or asymmetrical, high determination precision of the misregistration amount can be kept.

Note that from a viewpoint of reliably excluding an inappropriate comparison result from the comparison results that are used in determination of the misregistration amount, a safety factor (predetermined value β) may be used. For example, the CPU 70 includes the comparison result corresponding to the pattern of the second color in the comparison result that is used in determination of the misregistration amount when tc+β<tb is established, but may exclude the comparison result corresponding to the pattern of the second color from the comparison result that is used in determination of the misregistration amount when tc+β≥tb is established.

Further, in setting the threshold, the pattern image PT2 with a wide pattern interval is used instead of the pattern image PT1 that is used in misregistration detection, so that the threshold for each color pattern can be set with high precision. Note that in setting the thresholds (FIG. 6), the pattern image PT1 that is used in misregistration detection may be used. Note that the method for setting the threshold for each color pattern for each color is not limited to the illustrated method.

Second Embodiment

Hereinafter, a second embodiment will be described. In the second embodiment, same structures as in the first embodiment will be assigned with the same reference signs and explanation will be omitted. The image forming apparatus 1 and the sensor 40 in the second embodiment are similar to those in the first embodiment, and therefore explanation will be omitted.

(Control Mechanism)

Figure 13:
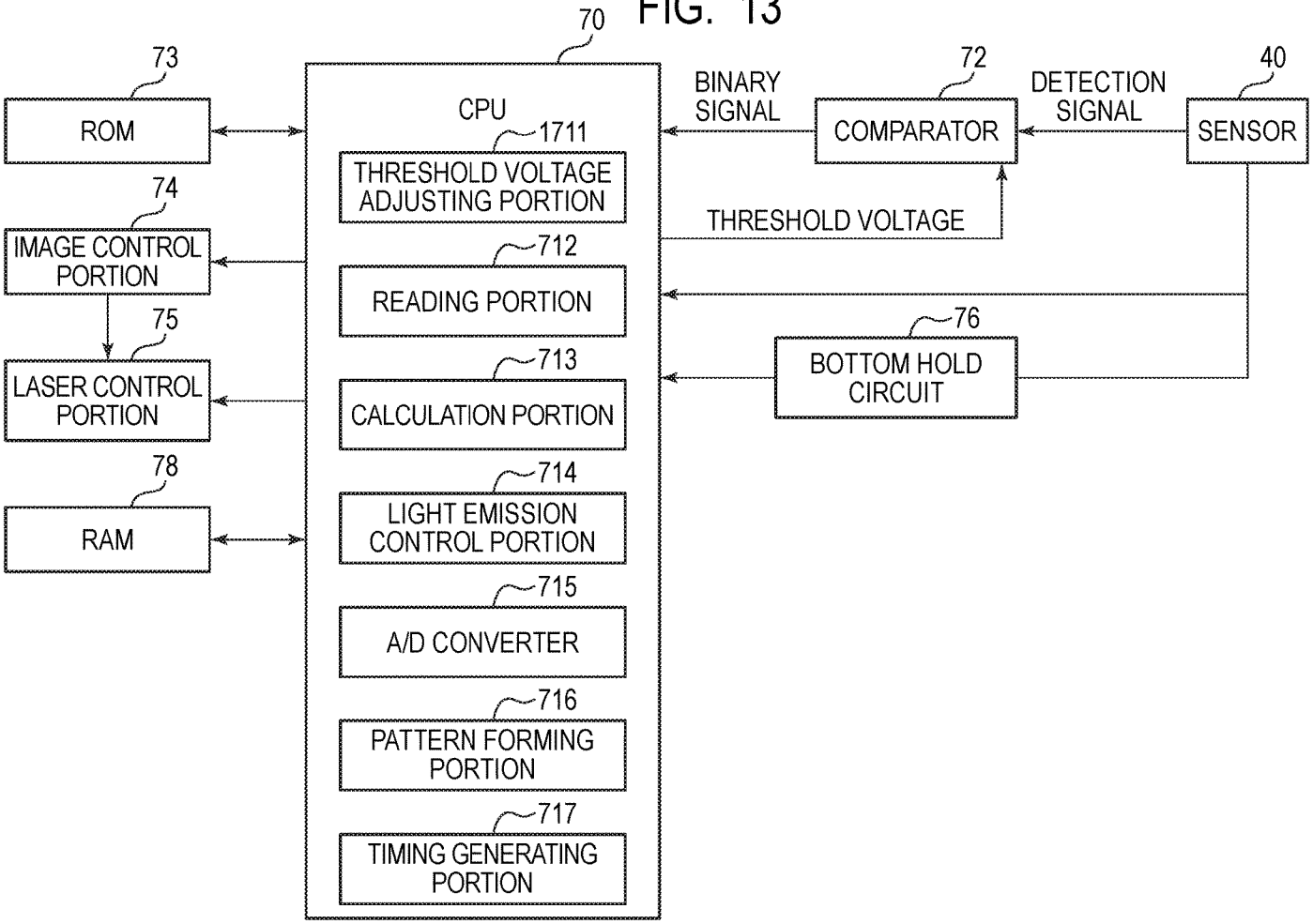
FIG. 13 is a block diagram of a control mechanism of a second embodiment.

A control mechanism of the image forming apparatus 1 of the second embodiment will be described with use of FIG. 13. FIG. 13 is a block diagram of the control mechanism of the second embodiment. In FIG. 13, same structures as the structures of the control mechanism of the first embodiment illustrated in FIG. 3 are assigned with the same reference signs and explanation will be omitted. In the first embodiment, the RC circuit 77 smoothes the PWM signal output from the CPU 70 and generates the threshold th. In the second embodiment, the RC circuit 77 is omitted. The sensor 40 outputs a sensor output of the pattern image PT1 (misregistration detecting pattern) as a detection signal as described above. The sensor output is input to the comparator 72, and is binarized with a threshold voltage which is set in advance by the CPU 70. The threshold voltage is output from a threshold voltage adjusting portion 1711 of the CPU 70. A binary signal that is binarized by the comparator 72 is input to the CPU 70.

The CPU 70 has the threshold voltage adjusting portion 1711. The threshold voltage adjusting portion 1711 generates a threshold voltage by a D/A converter. A misregistration calculation method by the calculation portion 713 is the same as that in the first embodiment, and therefore explanation will be omitted. Further, a threshold voltage setting process in the second embodiment is the same as the threshold setting process in the first embodiment, and therefore explanation will be omitted.

(Misregistration Amount Obtaining Process)

Figure 14:
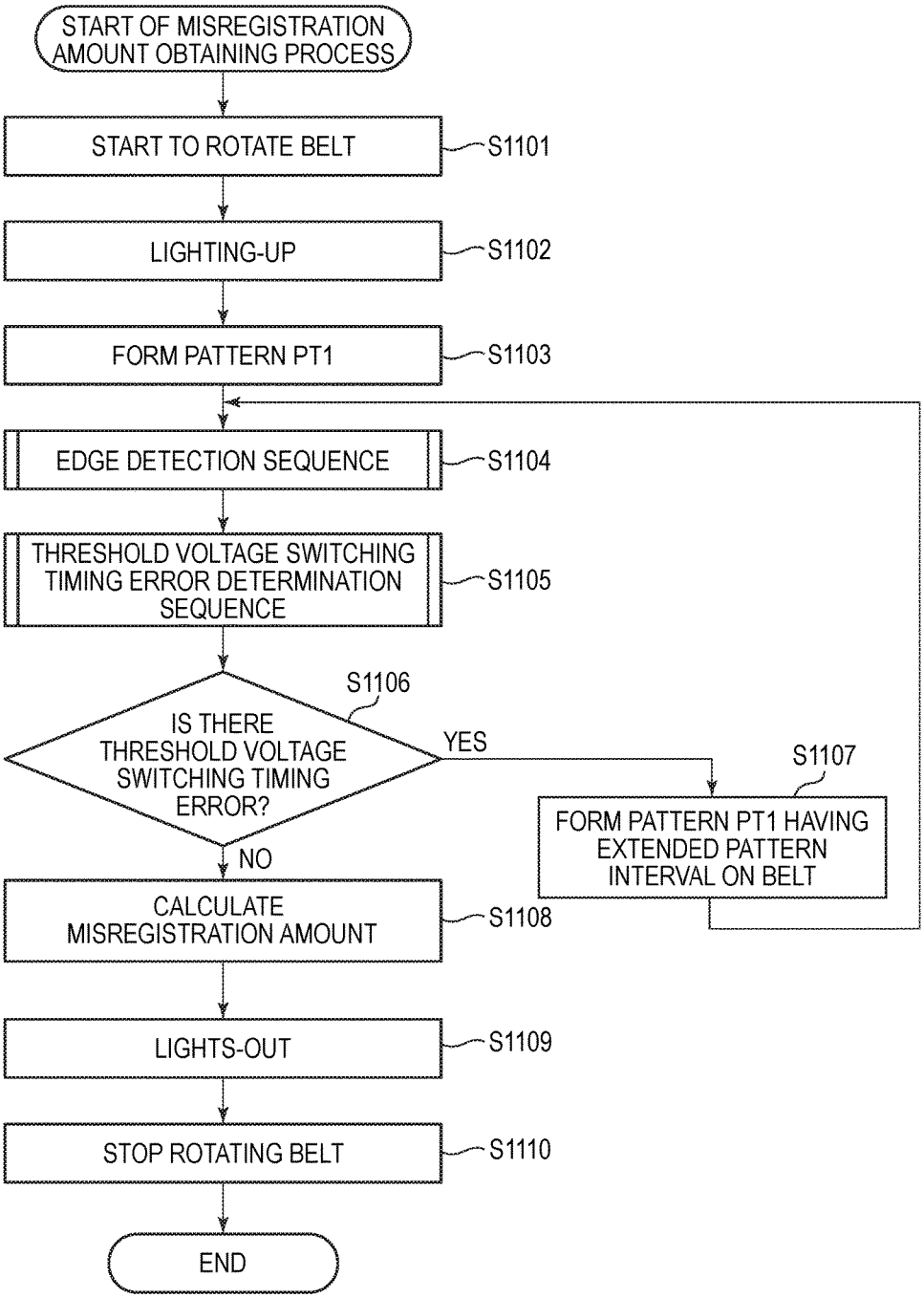
FIG. 14 is a flowchart of a misregistration amount obtaining process of the second embodiment.

With use of FIG. 14, a misregistration amount obtaining process will be described. FIG. 14 is a flowchart of a misregistration amount obtaining process in the second embodiment. The CPU 70 executes the misregistration amount obtaining process in accordance with a program stored in the ROM 73.

The CPU 70 starts the misregistration amount obtaining process when the main power source is turned on, or after a specified number of images or more are formed. A starting condition is the same as that of the threshold voltage setting process, and the threshold voltage setting process is performed in advance.

When the misregistration amount obtaining process is started, the CPU 70 starts to rotate the intermediate transfer belt (S1101), lights up the light emitting portion 51 (S1102), and forms the pattern image PT1 on the intermediate transfer belt 8 (S1103). Subsequently, the CPU 70 starts an edge detection sequence (S1104) and a threshold voltage switching timing error determination sequence (S1105).

Here, the edge detection sequence (S1104) is executed to detect the pattern image PT1 of respective colors. In the edge detection sequence, the CPU 70 sets the threshold voltages of the respective colors and detects edges at a leading edge and a trailing edge of the pattern image PT1, and calculates time information of the pattern of yellow that is the reference color and the patterns of the other colors. Details of the edge detection sequence will be described later. Further, the threshold voltage switching timing error determination sequence (S1105) is executed to determine whether or not threshold voltage switching is performed during pattern detection. Details of the threshold voltage switching timing error determination sequence will be also described later.

When these sequences are ended, the CPU 70 determines whether or not there is a threshold voltage switching timing error (S1106). When there is the error (YES in S1106), the CPU 70 forms the pattern image PT1 on the intermediate transfer belt 8 again. At this time, the CPU 70 forms the pattern image PT1 by extending a pattern interval of each color (S1107), and shifts the process to S1104. Here, the reason why the pattern interval of each color is extended is that as a result of the interval of the pattern image PT1 becomes narrow, the pattern of the next color is detected before the threshold voltage is switched. By extending the pattern interval of each color in this way, the threshold voltage switching timing error can be eliminated.

When there is no error in S1106 (NO in S1106), the CPU 70 calculates a misregistration amount of each color (S1108). When calculation of the misregistration amount is ended, the CPU 70 lights out the light emitting portion 51 (S1109), stops the intermediate transfer belt 8 (S1110), and ends the misregistration amount obtaining process.

(Edge Detection Sequence)

Figure 15:
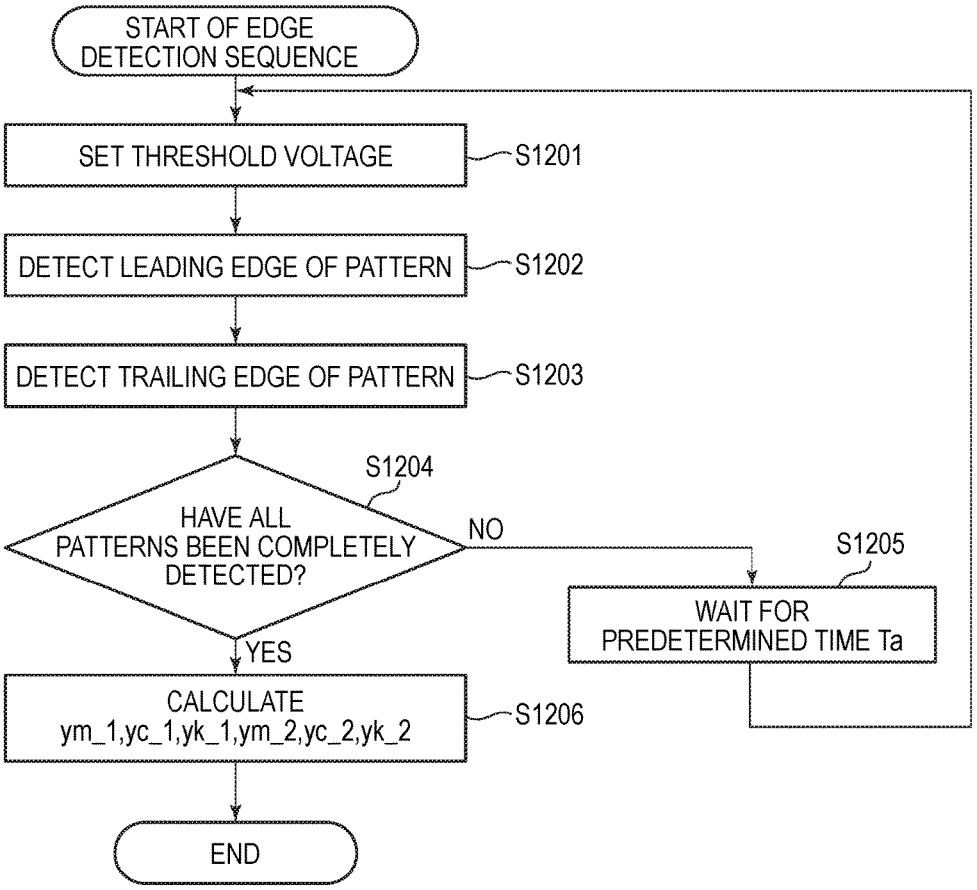
FIG. 15 is a flowchart of an edge detection sequence of the second embodiment.

With use of FIG. 15, the edge detection sequence of the second embodiment will be described.

The CPU 70 starts the edge detection sequence in S1104 (FIG. 14) of the misregistration amount obtaining process.

When the edge detection sequence is started, the CPU 70 sets the threshold voltage first (S1201). In the second embodiment, the pattern 801 of yellow that is the reference color is formed first as illustrated in FIG. 4A, and therefore, a threshold voltage for yellow is set. Subsequently, the leading edge of the pattern, that is, the rising edge of the signal obtained by binarizing the sensor output of the sensor 40 by the comparator 72 is detected (S1202). Subsequently, the trailing edge of the pattern, that is, the falling edge of the binarized signal is detected (S1203).

Next, the CPU 70 determines whether all patterns have been completely detected (S1204). When the CPU 70 determines that all patterns have not been completely detected (NO in S1204), the CPU 70 waits for a predetermined time Ta, and thereafter shifts to S1201 to set the threshold voltage of the next color. Here, the reason why the CPU 70 waits for the predetermined time Ta is that if the CPU 70 switches the threshold voltage to the threshold voltage of the next color immediately after detecting the trailing edge of the pattern in S1203, the CPU 70 is likely to detect the trailing edge twice.

In the present embodiment, the pattern 802 of magenta follows the pattern 801 of yellow, and S1201 to S1205 are executed similarly for the pattern 802 to the cyan pattern 813. Subsequently, when S1201 to S1203 are executed with respect to the black pattern 814, detection of all the patterns is ended.

Then, the CPU 70 determines that pattern detection is ended (YES in S1204). Subsequently, the CPU 70 calculates ym_1, yc_1, yk_1, ym_2, yc_2 and yk_2 that are time information of the patterns of the respective colors to the reference color (S1206), and ends the edge detection sequence.

(Threshold Switching Timing Error Determination)

Next, the threshold switching timing error determination will be described.

Figure 16A:
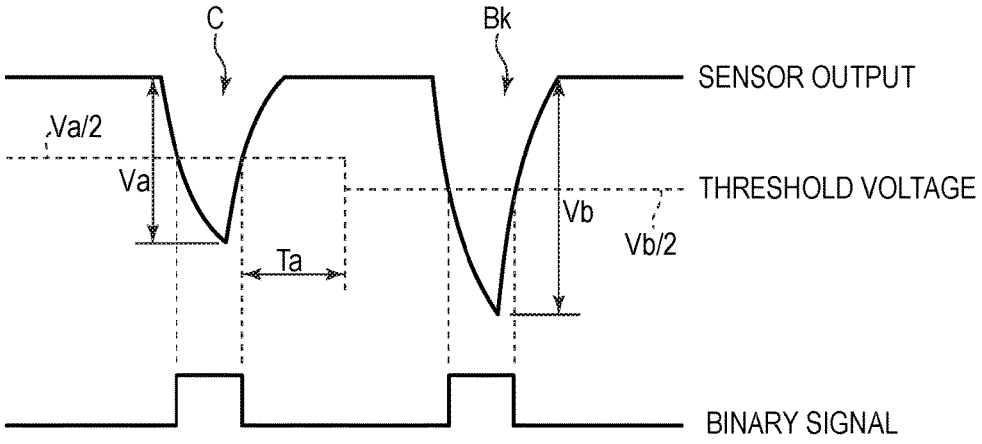
FIGS. 16A and 16B are schematic diagrams of sensor outputs of a sensor and threshold voltage switching timings in the second embodiment.
Figure 16B:
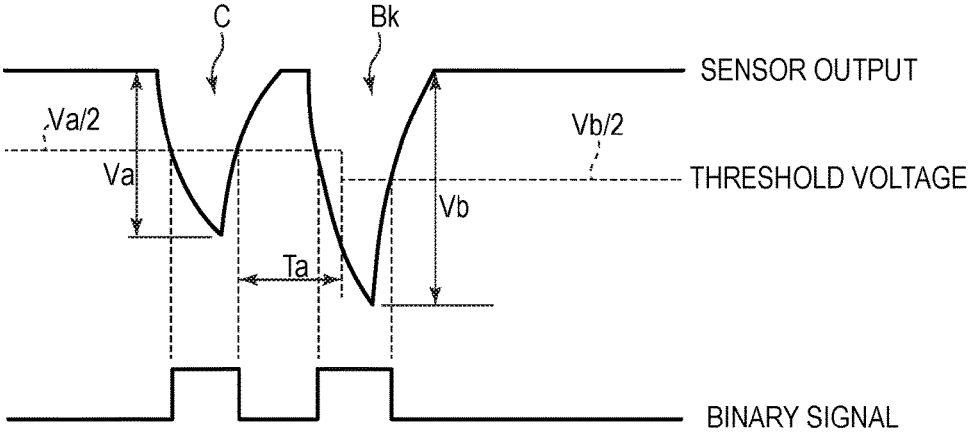

FIGS. 16A and 16B are diagrams each illustrating a relationship among the sensor output of the sensor 40 at a time of detection of the pattern image PT1, the binary signal obtained by binarizing the sensor output with the threshold voltage in the comparator 72, and the threshold voltage.

FIG. 16A illustrates a case where switching of the threshold voltage at a normal time is performed, and FIG. 16B illustrates a case where a switching timing error of the threshold voltage occurs. When detecting the pattern image PT1, the CPU 70 switches the threshold voltage in the threshold voltage adjusting portion 1711 so that the threshold voltage is switched between the patterns. The threshold voltage is switched after the predetermined time Ta with a falling edge of a binary signal of a previous pattern as a reference. FIGS. 16A and 16B both illustrate switching of the threshold voltage to a threshold voltage Vb/2 (1.6 V) of black from the threshold voltage Va/2 (1.7 V) of cyan when patterns of cyan (C) and black (Bk) are detected. The CPU 70 determines whether the binary signal is at a low level or a high level in a timing Ta at which the threshold voltage is switched to a threshold voltage for black from a threshold voltage for cyan. Thereby, association of switching of the threshold voltage with the value of the binary signal is performed.

When attention is paid to black, switching of the threshold voltage is completed before the black pattern is detected in FIG. 16A, and as for the binary signal of black, the rising edge and the falling edge are both binarized with the threshold voltage Vb/2 of black. That is, switch to the threshold voltage Vb/2 of black from the threshold voltage Va/2 of cyan is performed when the binary signal is at the low level. In this case, it is determined that there is no threshold voltage switching timing error.

On the other hand, in FIG. 16B, the threshold voltage is switched during detection of the black pattern. Therefore, at the rising edge of the binary signal of black, the threshold voltage is set at the threshold voltage Va/2 for cyan, whereas at the falling edge, the threshold voltage is set at the threshold voltage Vb/2 for black. That is, switch to the threshold voltage Vb/2 for black from the threshold voltage Va/2 for cyan is performed when the binary signal is at the high level. In this case, it is determined that a threshold voltage switching timing error occurs.

(Threshold Voltage Switching Timing Error Determination Sequence)

Figure 17:
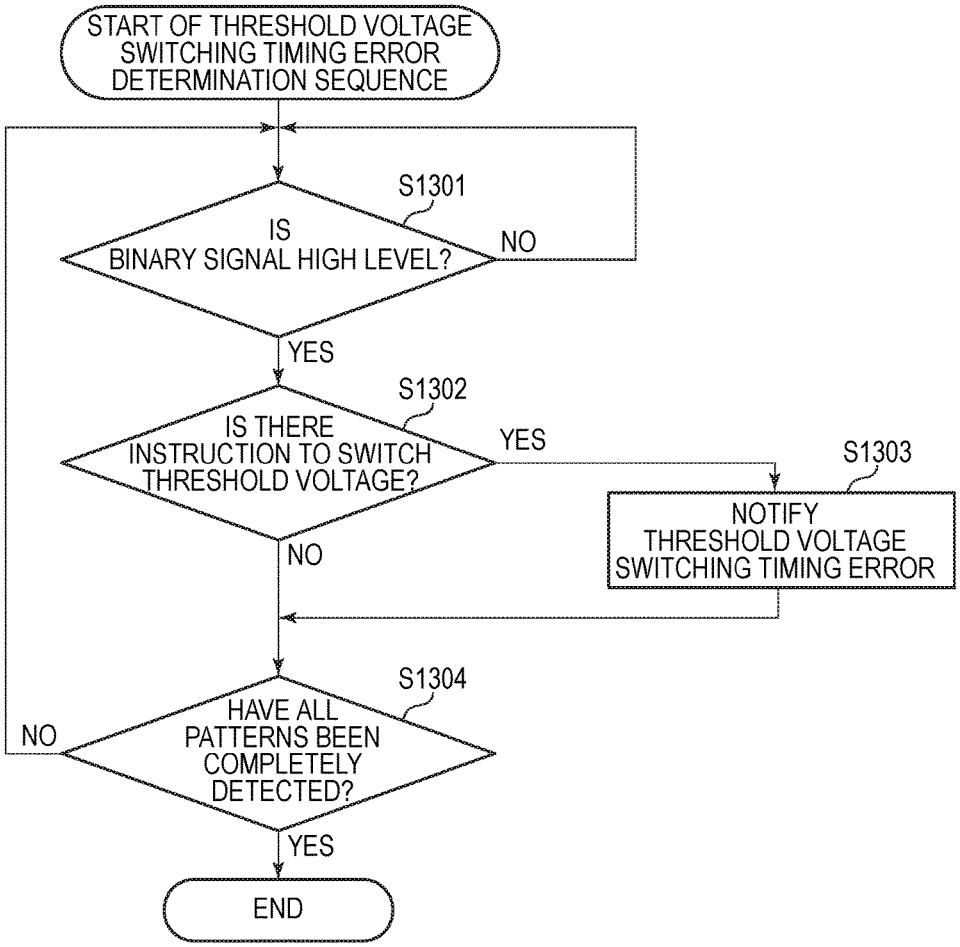
FIG. 17 is a flowchart of a threshold voltage switching timing error determination sequence of the second embodiment.

With reference to FIG. 17, the sequence of the threshold switching timing error determination will be described.

The CPU 70 starts the threshold switching timing error determination sequence in S1105 (FIG. 14) of the misregistration amount obtaining process.

When the threshold switching timing error determination sequence is started, the CPU 70 firstly determines whether or not the binary signal is at the high level (S1301). When the CPU 70 determines that the binary signal is at the low level (NO in S1301), the CPU 70 returns to S1301 and waits until the binary signal reaches the high level. On the other hand, when the CPU 70 determines that the binary signal is at the high level (YES in S1301), the CPU 70 determines whether or not there is an instruction to switch the threshold voltage (S1302). When the CPU 70 determines that there is the instruction to switch the threshold voltage (YES in S1302), the CPU 70 determines that the threshold voltage is switched during pattern detection, and notifies a threshold voltage switching timing error (S1303). On the other hand, when the CPU 70 determines that there is no instruction to switch the threshold voltage (NO in S1302), the CPU 70 determines whether or not all the patterns have been completely detected (S1304). When the CPU 70 determines that all the patterns have not been completely detected (NO in S1304), the CPU 70 returns to S1301 and performs the threshold switching timing error determination of the next pattern.

In the present embodiment, as illustrated in FIG. 4A, S1301 to S1302 are executed first for the pattern 801 of yellow which is the reference color, and S1301 to S1302 are executed similarly for the magenta pattern 802 to the black pattern 814. Subsequently, when the CPU 70 determines that all the patterns have been completely detected (YES in S1304), the CPU 70 ends the threshold switching timing error determination sequence.

According to the second embodiment, the misregistration amount can be restrained from being erroneously corrected.

Third Embodiment

Hereinafter, a third embodiment will be described. In the third embodiment, same structures as in the first embodiment and the second embodiment will be assigned with the same reference signs and explanation will be omitted. The image forming apparatus 1 and the sensor 40 of the third embodiment are the same as those in the first embodiment, and therefore explanation will be omitted. The control mechanism of the third embodiment is the same as in the second embodiment, and explanation will be omitted.

In the third embodiment, determination of the threshold voltage switching timing error is not performed, and threshold voltage is not switched during detection of the pattern image PT1. That is, the threshold voltage is switched only when the binary signal is at a low level which is a state where the pattern image PT1 is not detected. On the other hand, when the binary signal is at a high level which is a state where the pattern image PT1 is detected, the threshold voltage is not switched. Thereby, binarization is not performed with different threshold voltages at the rising edge and the falling edge of the binary signal, and a detection error of the pattern image PT1 is reduced.

The third embodiment differs from the second embodiment in misregistration amount obtaining process and edge detection sequence, so that the third embodiment will be described hereinafter. Note that the threshold voltage setting process is the same as that in the first embodiment, and therefore explanation will be omitted. Hereinafter the third embodiment will be described with use of FIGS. 18, 19 and 20.

(Misregistration Amount Obtaining Process)

Figure 18:
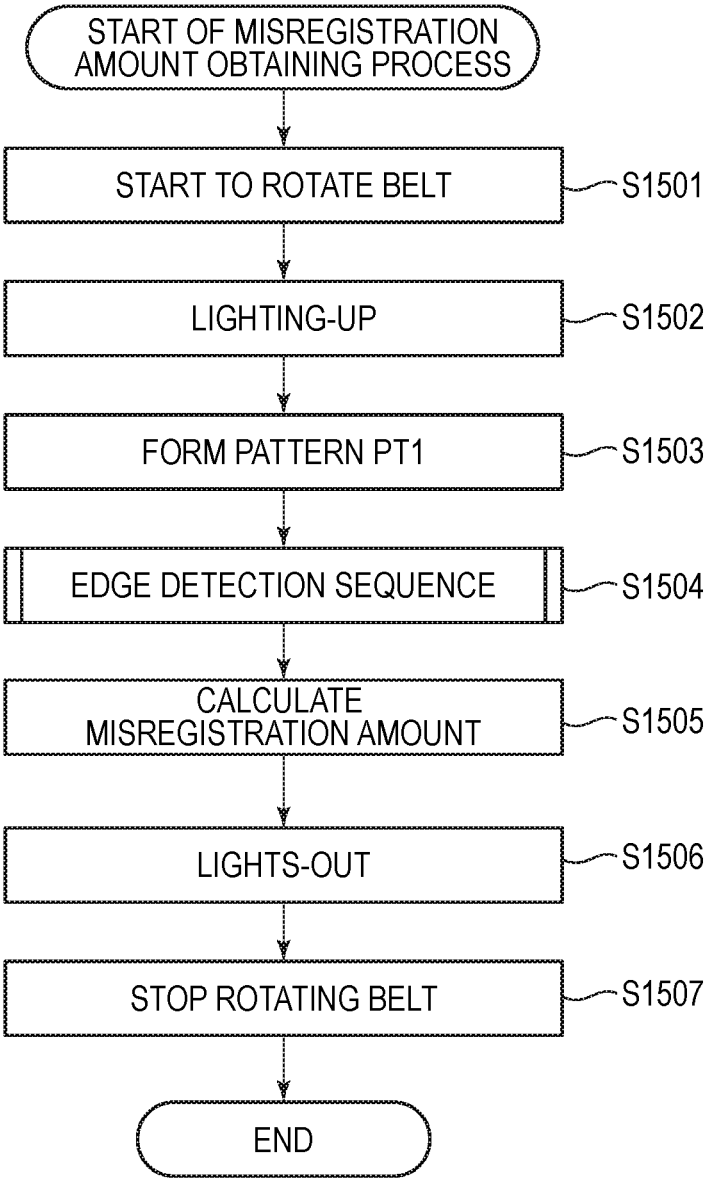
FIG. 18 is a flowchart of a misregistration amount obtaining process of a third embodiment.

A misregistration amount obtaining process of the third embodiment will be described with use of FIG. 18. The CPU 70 executes the misregistration amount obtaining process in accordance with a program stored in the ROM 73.

The CPU 70 starts the misregistration amount obtaining process when the main power source is turned on, or after a specified number of images or more are formed. A starting condition is the same as the threshold voltage setting process, and the threshold voltage setting process is performed in advance.

When the misregistration amount obtaining process is started, the CPU 70 starts to rotate the intermediate transfer belt (S1501), lights up the light emitting portion 51 (S1502), and forms the pattern image PT1 on the intermediate transfer belt 8 (S1503). Subsequently, the CPU 70 starts an edge detection sequence (S1504). After the edge detection sequence is ended, the CPU 70 calculates a misregistration amount of each color (S1505). When the CPU 70 ends calculation of the misregistration amount, the CPU 70 lights out the light emitting portion 51 (S1506), and stops the intermediate transfer belt 8 (S1507). Thereby, the misregistration amount obtaining process is ended.

(Edge Detection Sequence)

Figure 19:
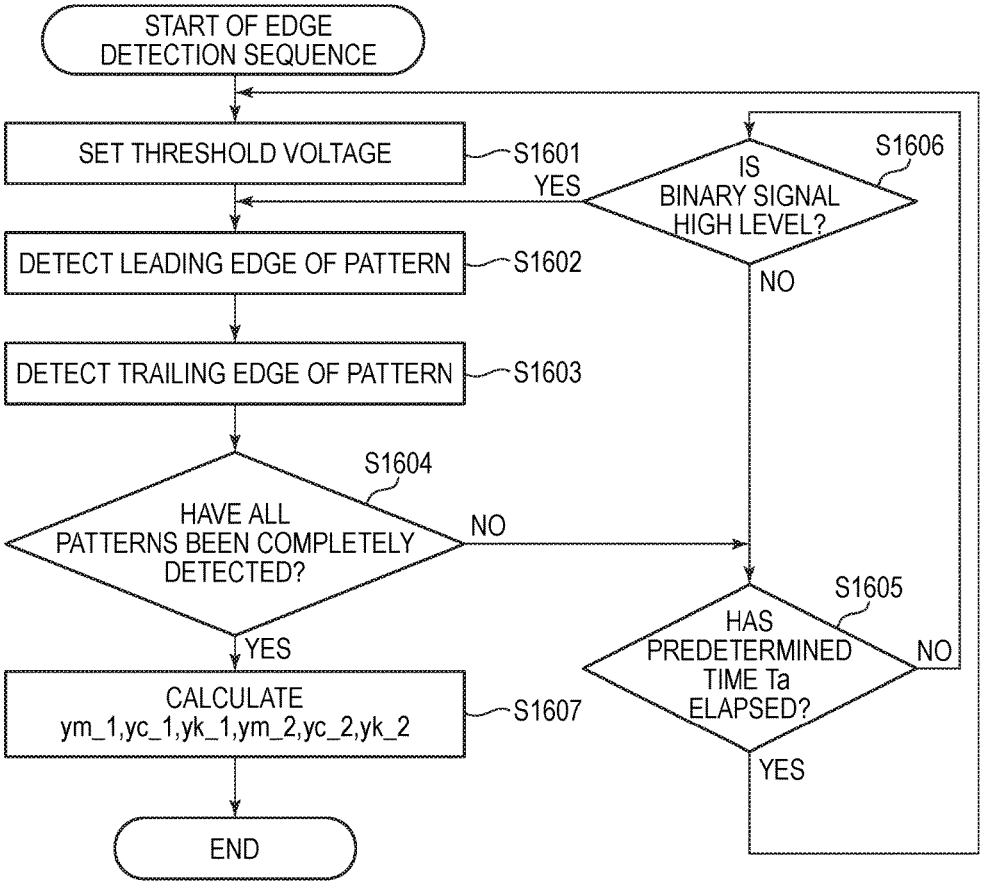
FIG. 19 is an explanatory diagram of an edge detection sequence that is executed in the third embodiment.

The edge detection sequence of the third embodiment will be described with use of FIG. 19.

The CPU 70 starts the edge detection sequence in S1504 (FIG. 18) of the misregistration amount obtaining process. When the edge detection sequence is started, the CPU 70 sets a threshold voltage first (S1601). In the present embodiment, the pattern 801 of yellow that is the reference color is formed first as illustrated in FIG. 4A, so that the threshold voltage for yellow is set.

Thereafter, the CPU 70 detects a leading edge of the pattern, that is, a rising edge of a signal obtained by binarizing the sensor output of the sensor 40 by the comparator 72 (S1602). Thereafter, the CPU 70 detects a trailing edge of the pattern, that is, a falling edge of the binarized signal (S1603).

Next, the CPU 70 determines whether or not all the patterns have been completely detected (S1604). When the CPU 70 determines that all the patterns have not been completely detected (NO in S1604), the CPU 70 determines whether or not the predetermined time Ta has elapsed (S1605).

When the CPU 70 determines that the predetermined time Ta has elapsed (YES in S1605), the CPU 70 shifts to S1601, and sets a threshold voltage for the next color. On the other hand, when the CPU 70 determines that the predetermined time Ta has not elapsed (NO in S1605), the CPU 70 determines whether or not the binary signal is at a high level (S1606). When the CPU 70 determines that the binary signal is at a low level (NO in S1606), the CPU 70 returns to S1605 and determines whether the predetermined time Ta has elapsed again. On the other hand, when the CPU 70 determines that the binary signal is at the high level although the predetermined time Ta has not elapsed (YES in S1606), the CPU 70 shifts to S1602. In this case, a rising edge at the leading edge of the pattern is detected without switching the threshold voltage. In this way, a timing at which the threshold voltage after a lapse of the predetermined time Ta should be adjusted, and the value of the binary signal at that point of time are associated with each other.

Figure 20:
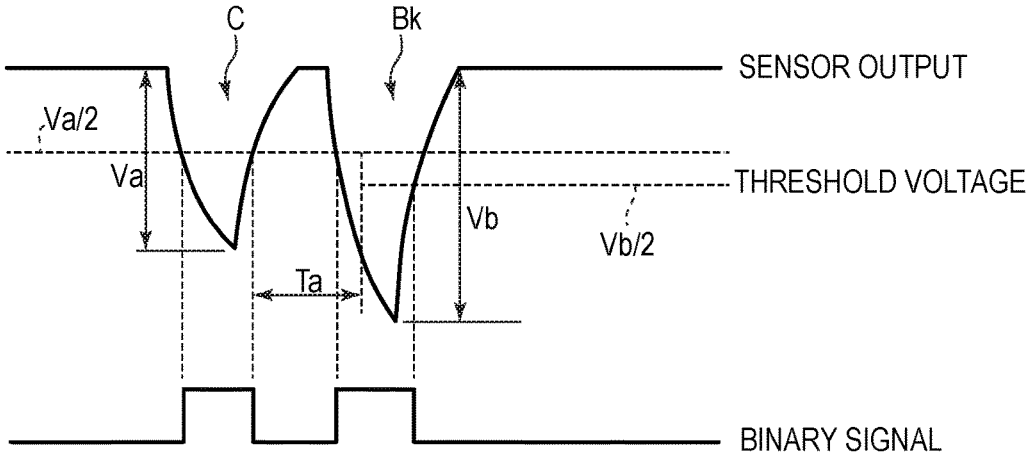
FIG. 20 is a schematic diagram of a sensor output of a sensor and a threshold voltage in the third embodiment.

That is, as illustrated in FIG. 20, when the binary signal reaches the high level before the predetermined time Ta elapses after the CPU 70 detects the edge at the trailing edge of the pattern, the threshold voltage is not switched when the predetermined time Ta elapses. This is because the pattern image PT1 of the next color is detected before the predetermined time Ta elapses. In this way, the leading edge and the trailing edge of the pattern image PT1 are detected by using the threshold voltage of the previous color, whereby a detection error by binarizing the rising edge and the falling edge of the binary signal with different threshold voltages is avoided.

In the present embodiment, next to the pattern 801 of yellow, the magenta pattern 802 follows, and S1601 to S1606 are executed similarly to the magenta pattern 802 to the cyan pattern 813. Subsequently, when S1601 to S1603 are executed with respect to the black pattern 814, all the patterns have been completely detected. When it is determined that all the patterns have been completely detected (YES in S1604), the CPU 70 calculates ym_1, yc_1, yk_1, ym_2, yc_2 and yk_2 that are time information of the patterns of the respective colors to the reference color (S1607). Subsequently, the edge detection sequence is ended.

As above, in the third embodiment, when the relationship between an interval of the pattern image PT1 and the switching timing of the threshold voltage is broken down, the leading edge and the trailing edge of the pattern image PT1 are detected by using the threshold voltage of the previous color without switching the threshold voltage, and thereby reduction in misregistration correction precision by erroneous detection is restrained.

According to the third embodiment, the misregistration amount can be restrained from being erroneously corrected.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-212906, filed Nov. 2, 2017, and Japanese Patent Application No. 2017-215269, filed Nov. 8, 2017, which are hereby incorporated by reference herein in their entirety.

What is claimed is:

1. An image forming apparatus which forms an image on a sheet, the image forming apparatus comprising:

a plurality of image forming units configured to form images of different colors;

a transfer member on which color patterns of the different colors formed by the plurality of image forming units are transferred, the color patterns being conveyed by the transfer member;

a sensor configured to measure the color patterns on the transfer member;

a comparator configured to compare values of the color patterns measured by the sensor with a threshold;

a circuit configured to control the threshold; and a controller configured to:

determine whether the threshold corresponds to a target threshold for a current color pattern among the color patterns while the color patterns are measured by the sensor, detect color misregistration concerning the color patterns based on a comparison result of the comparator, and control relative positions of images of the different colors to be formed by the plurality of image forming units, based on the color misregistration.

2. The image forming apparatus according to claim 1, wherein in a case in which the threshold does not correspond to the target threshold, the controller controls the relative positions without using the color misregistration concerning the color patterns.

3. The image forming apparatus according to claim 1, wherein the controller determines that the threshold does not correspond to the target threshold in a case in which the current color pattern is measured by the sensor before the threshold corresponds to the target threshold for the current color pattern among the color patterns.

4. The image forming apparatus according to claim 1, wherein the color patterns include a first color pattern of a first color and a second color pattern of a second color different from the first color, wherein the second color pattern is transferred upstream of the first color pattern adjacently to the first color pattern in a conveyance direction of the transfer member, and wherein the controller determines that the threshold does not correspond to the target threshold in a case in which the second color pattern is measured by the sensor before the threshold reaches a second target threshold for the second color pattern from a first target threshold for the first color pattern.

5. The image forming apparatus according to claim 1, wherein the controller determines that the threshold does not correspond to the target threshold based on a time from when a trailing edge of a preceding color pattern among the color patterns is detected based on the comparison result until a leading edge of the current color pattern among the color patterns is detected based on the comparison result.

6. The image forming apparatus according to claim 1, wherein the controller determines that the threshold does not correspond to the target threshold in a case in which a time from when a trailing edge of a preceding color pattern among the color patterns is detected based on the comparison result until a leading edge of the current color pattern among the color patterns is detected based on the comparison result is shorter than a predetermined time.

7. The image forming apparatus according to claim 1, wherein the controller determines that the threshold does not correspond to the target threshold based on the comparison result of the comparator after a predetermined time has elapsed from when a trailing edge of a preceding color pattern among the color patterns is detected based on the comparison result.

8. The image forming apparatus according to claim 1, wherein the controller determines that the threshold does not correspond to the target threshold in a case in which the comparison result of the comparator after a predetermined time has elapsed from when a trailing edge of a preceding color pattern among the color patterns is detected based on the comparison result indicates that the current color pattern is detected.

9. The image forming apparatus according to claim 1, wherein the controller sets the target threshold for the current color pattern as the threshold by the circuit while the color patterns are measured by the sensor, when a predetermined time has elapsed from when a trailing edge of a preceding color pattern among the color patterns is detected based on the comparison result.

10. The image forming apparatus according to claim 1, wherein the circuit includes a resistance and a capacitor, and wherein the threshold is controlled based on a PWM signal from the controller.

11. An image forming apparatus which forms an image on a sheet, the image forming apparatus comprising:

a plurality of image forming units configured to form images of different colors;

a transfer member on which color patterns formed by the plurality of image forming units are transferred, wherein the color patterns include a first pattern of a first color and a second pattern of a second color different from the first color, and wherein the second pattern is transferred upstream of the first pattern adjacently to the first pattern with respect to a conveyance direction of the transfer member;

a sensor configured to measure the color patterns on the transfer member;

a comparator configured to compare a measured value output by the sensor with a threshold value;

a circuit configured to control the threshold value corresponding to each of the color patterns; and a controller configured to:

determine whether the threshold value is changed from a first threshold value for the first pattern to a second threshold value for the second pattern before the second pattern is measured by the sensor, detect color misregistration related to the color patterns based on a comparison result of the comparator, and control relative positions of images of the different colors to be formed by the plurality of image forming units, based on the detected color misregistration.

12. The image forming apparatus according to claim 11, wherein in a case in which the threshold value is not changed from the first threshold value for the first pattern to the second threshold value for the second pattern before the second pattern is measured by the sensor, the controller controls the plurality of image forming units to form other color patterns including another first color pattern and another second color pattern, and wherein an interval between the other first color pattern and the other second color pattern with respect to the conveyance direction is wider than an interval between the first color pattern and the second color pattern with respect to the conveyance direction.

13. The image forming apparatus according to claim 11, wherein based on a time from when a trailing edge of the first pattern is detected based on the comparison result until a leading edge of the second pattern is detected based on the comparison result, the controller determines whether the threshold value is changed from the first threshold value for the first pattern to the second threshold value for the second pattern before the second pattern is measured by the sensor.

14. The image forming apparatus according to claim 11, wherein in a case in which a time from when a trailing edge of the first pattern is detected based on the comparison result until a leading edge of the second pattern is detected based on the comparison result is shorter than a predetermined time, the controller determines that the threshold value is changed from the first threshold value for the first pattern to the second threshold value for the second pattern before the second pattern is measured by the sensor.

15. The image forming apparatus according to claim 11, wherein based on the comparison result of the comparator after a predetermined time has elapsed since a trailing edge of the first pattern is detected based on the comparison result, the controller determines whether the threshold value is changed from the first threshold value for the first pattern to the second threshold value for the second pattern before the second pattern is measured by the sensor.

16. The image forming apparatus according to claim 11, wherein in a case in which the comparison result of the comparator after a predetermined time has elapsed since a trailing edge of the first pattern is detected based on the comparison result indicates that the second pattern is detected, the controller determines that the threshold value is changed from the first threshold value for the first pattern to the second threshold value for the second pattern before the second pattern is measured by the sensor.

17. The image forming apparatus according to claim 11, wherein the circuit includes a resistance and a capacitor, and wherein the threshold value is controlled based on a PWM signal from the controller.

* * * * *